US011268741B2

(12) United States Patent
Sato et al.

(10) Patent No.: US 11,268,741 B2
(45) Date of Patent: Mar. 8, 2022

(54) REFRIGERANT CONTROL SYSTEM AND COOLING SYSTEM

(71) Applicant: ATS Japan Co., Ltd., Tokyo (JP)

(72) Inventors: Toshimi Sato, Tokyo (JP); Kazushige Shimizu, Tokyo (JP); Yasuhiro Fukami, Tokyo (JP); Tomoyuki Kariya, Tokyo (JP)

(73) Assignee: ATS Japan Co., Ltd., Tokyo (JP)

( * ) Notice: Subject to any disclaimer, the term of this patent is extended or adjusted under 35 U.S.C. 154(b) by 0 days.

(21) Appl. No.: 17/129,385

(22) Filed: Dec. 21, 2020

(65) Prior Publication Data

US 2021/0285703 A1 Sep. 16, 2021

Related U.S. Application Data

(63) Continuation-in-part of application No. PCT/JP2020/010241, filed on Mar. 10, 2020.

(51) Int. Cl.
*F25B 41/20* (2021.01)
*F25B 49/02* (2006.01)

(52) U.S. Cl.
CPC ..... *F25B 41/20* (2021.01); *F25B 49/02* (2013.01)

(58) Field of Classification Search
CPC ..... F24B 41/20; F24B 49/02
See application file for complete search history.

(56) References Cited

U.S. PATENT DOCUMENTS 5,651,265 A * 7/1997 Grenier ..... F25B 30/06 62/260
2011/0154840 A1* 6/2011 Mihara ..... F25B 45/00 62/196.1

(Continued)

FOREIGN PATENT DOCUMENTS

EP 2995885 A1 3/2016
JP 57-144854 A 9/1982
JP 57-207772 A 12/1982

(Continued)

OTHER PUBLICATIONS

Inoue et al., Air Conditioner, Aug. 22, 2013, JP2013164242A, Whole Document (Year: 2013).*

*Primary Examiner* — Larry L Furdge
(74) *Attorney, Agent, or Firm* — Reinhart Boerner Van Deuren P.C.

(57) ABSTRACT

A refrigerant control system includes: a storage part which stores a first refrigerant; a first sub-pipe which is connected to an outlet side pipe of a first circulation flow path; a second sub-pipe which is connected to an inlet side pipe of the first circulation flow path; a third sub-pipe which is connected to the inlet side pipe and is formed so that heat of the third sub-pipe lower than heat of the outlet side pipe is able to be transferred to the first refrigerant in the storage part a first opening and closing valve which is provided in the first sub-pipe; a second opening and closing valve which is provided in the second sub-pipe; a third opening and closing valve which is provided in the third pipe; and an opening and closing control unit which performs opening and closing control of the first opening and closing valve, the second opening and closing valve, and the third opening and closing valve on the basis of a set temperature of a second refrigerant.

14 Claims, 11 Drawing Sheets

(56) References Cited

U.S. PATENT DOCUMENTS

| | | | | |
|---|---|---|---|---|
| 2014/0090407 | A1 | 4/2014 | Piesker | |
| 2018/0156513 | A1 * | 6/2018 | Javerschek | F25B 39/04 |

FOREIGN PATENT DOCUMENTS

| | | | | |
|---|---|---|---|---|
| JP | 61-208472 | A | | 9/1986 |
| JP | 2013164242 | | * | 8/2013 |
| JP | 2017-172873 | A | | 9/2017 |
| WO | WO 2014/181399 | A1 | | 11/2014 |

* cited by examiner

REFRIGERANT CONTROL SYSTEM AND COOLING SYSTEM

CROSS-REFERENCE TO RELATED PATENT APPLICATIONS

The present application is a continuation-in-part application of PCT application No. PCT/JP2020/010241 filed on Mar. 10, 2020, the disclosure of which is incorporated by reference in its entirety.

FIELD OF THE INVENTION

Incorporation by Reference

All publications and patent applications mentioned in this specification are herein incorporated by reference in their entirety to the same extent as if each individual publication or patent application was specifically and individually indicated to be incorporated by reference.

Technical Field

The present invention relates to a refrigerant control system and a cooling system.

Background Art

Conventionally, a device for cooling a cooling object has been proposed. For example, a device of Patent Document 1 includes a high source refrigeration cycle which connects a high source side compressor, a high source side condenser, a high source side diaphragm device, and a high source side evaporator through a pipe and circulates a refrigerant, a low source refrigeration cycle which connects a low source side compressor, an auxiliary radiator, a low source side condenser, a low source side diaphragm device, and a low source side evaporator through a pipe and circulates a refrigerant, and a cascade condenser which is configured by coupling the high source side evaporator and the low source side condenser to each other so as to exchange heat between the refrigerants passing therethrough. Further, since a suction side pipe of the low source side compressor in the pipe of the low source refrigeration cycle is connected to an expansion tank through a solenoid valve, a pressure in the low source refrigeration cycle can be adjusted so as not to be a set pressure or more in such a manner that the solenoid valve is opened and the refrigerant in the low source refrigeration cycle flows into the expansion tank. With such a configuration, it is possible to exchange heat between a cooling object disposed in the vicinity of the low source side evaporator of the low source refrigeration cycle and the refrigerant in the low source refrigeration cycle and to cool the cooling object.

CITATION LIST

Patent Document

Patent Document 1: International Publication WO 2014/181399

SUMMARY OF THE INVENTION

Technical Problem

Here, in the device of Patent Document 1, as described above, since the expansion tank is just used to collect the refrigerant flowing from the suction side pipe of the low source side compressor, the expansion tank increases in size, for example, when attempting to increase the refrigerant storage amount in the expansion tank. As a result, there is a risk that the installation cost of the expansion tank becomes excessive. Due to the above-described reason, there is room for improvement from the viewpoint of making a storage section in a compact size while increasing the refrigerant storage amount in the storage section such as the expansion tank.

It is an object of the present invention to solve the problems of the above mentioned prior arts.

Means to Solve the Problem

One aspect of the present invention provides a refrigerant control system for controlling a refrigerant flowing in a circulation flow path connected to a compression section and circulating the refrigerant compressed by the compression section so as to exchange heat between the refrigerant and a cooling object, the refrigerant control system comprises: a storage section which stores the refrigerant; a first pipe which is connected to an outlet side pipe constituting the circulation flow path and located on an outlet side of the compression section and allows the refrigerant in the outlet side pipe to flow into the storage section through the first pipe; a second pipe which is connected to an inlet side pipe constituting the circulation flow path and located on an inlet side of the compression section and allows the refrigerant in the storage section to flow into the inlet side pipe through the second pipe; a third pipe which is connected to the inlet side pipe and is formed so that heat of the third pipe lower than heat of the outlet side pipe is able to be transferred to the refrigerant in the storage section; a first opening and closing valve which is provided in the first pipe and switches whether or not to allow the refrigerant in the outlet side pipe to flow into the storage section; a second opening and closing valve which is provided in the second pipe and switches whether or not to allow the refrigerant in the storage section to flow into the inlet side pipe; a third opening and closing valve which is provided in the third pipe and switches whether or not to allow the refrigerant in an upstream part in relation to the storage section in the third pipe to flow into a part on the side of the storage section in the third pipe; and an opening and closing control section which performs opening and closing control of the first opening and closing valve, the second opening and closing valve, and the third opening and closing valve on the basis of a set temperature of the cooling object.

MODE FOR CARRYING OUT THE INVENTION

Hereinafter, embodiments of a refrigerant control system and a cooling system according to the invention will be described with reference to the accompanying drawings. First, the basic concept of the embodiment of [I] will be described, the specific content of the embodiment of [II] will be described, and finally the modified example of the embodiment of [III] will be described. However, the invention is not limited to the embodiments.

[I] Basic Concept of Embodiment

First, a basic concept of an embodiment will be described. The embodiment schematically relates to a cooling system and a refrigerant control system controlling a refrigerant flowing through a circulation flow path for circulating the refrigerant so that the refrigerant compressed by a compression section can exchange heat with a cooling object. Here, the "refrigerant" means a medium used for cooling a cooling object and is a concept including, for example, a gaseous refrigerant (for example, carbon dioxide, chlorofluorocarbon, air, and the like), a liquid refrigerant (for example, water and the like), and the like. However, in the embodiment, the refrigerant will be described as carbon dioxide. Further, the "cooling object" means an object to be cooled and is a concept including, for example, a device itself (or a system itself), a cooling refrigerant for the device (or system) (for example, a gaseous or liquid cooling refrigerant), and the like. However, in the embodiment, the cooling object will be described as a cooling refrigerant for a semiconductor manufacturing system (specifically, a liquid cooling refrigerant).

[II] Specific Content of Embodiment

Next, specific content of the embodiment will be described.

(Configuration)

Figure 1:
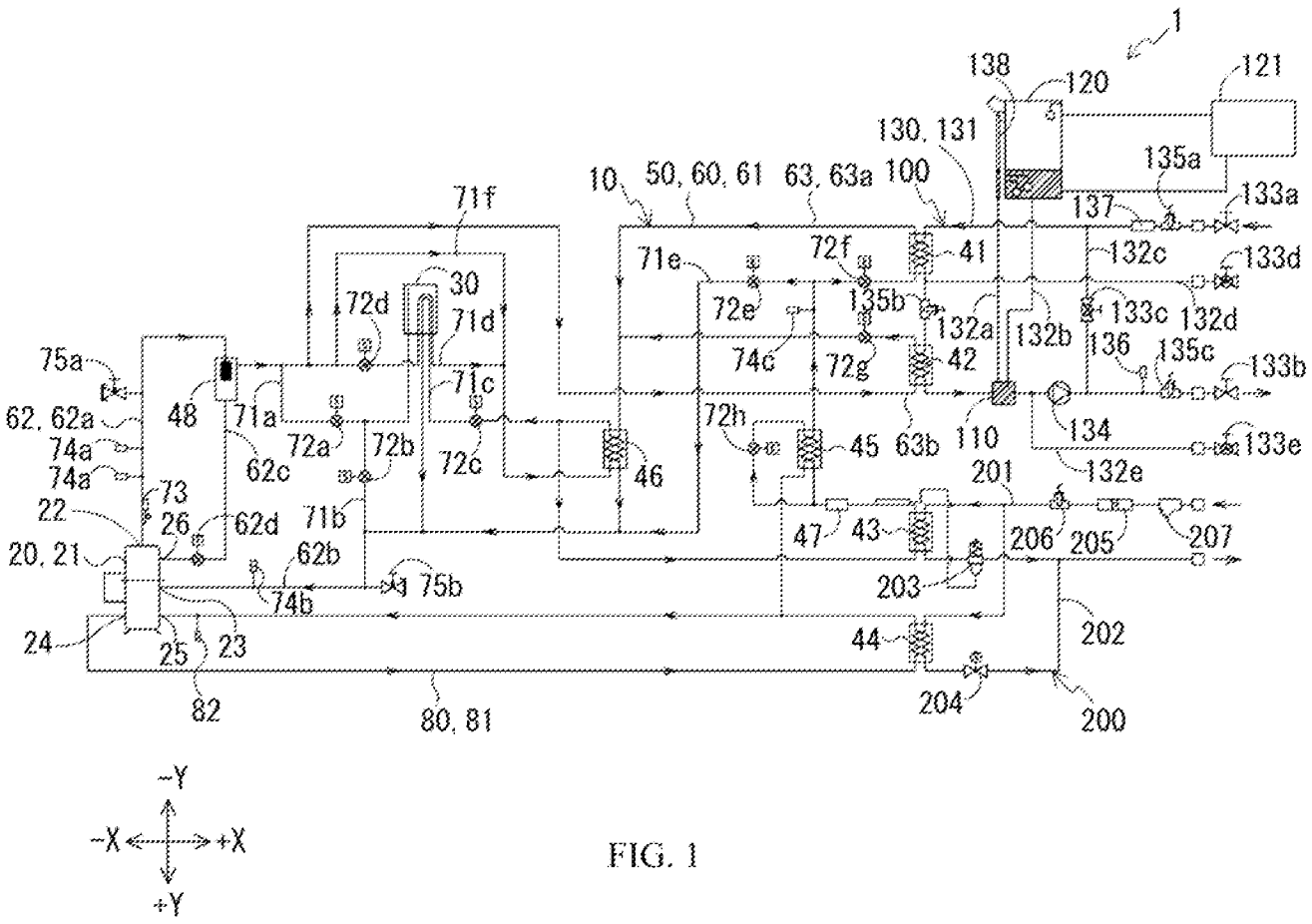
FIG. 1 is an outline diagram illustrating a cooling system according to an embodiment of the invention.
Figure 2:
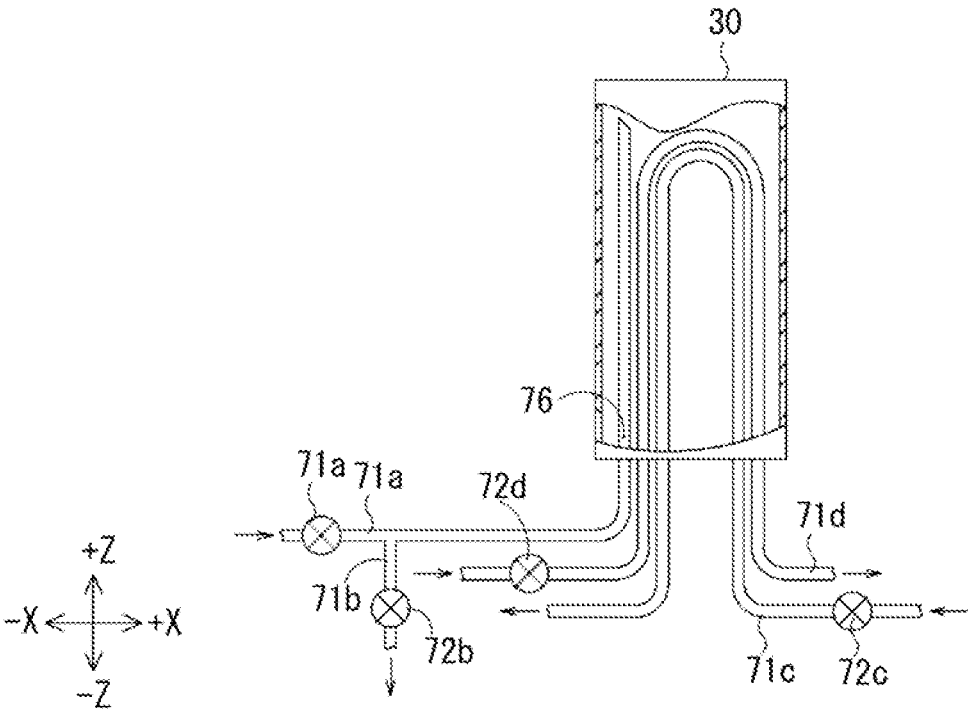
FIG. 2 is an enlarged view of an area of a storage part of FIG. 1.

First, a configuration of the cooling system according to the embodiment will be described. FIG. 1 is an outline diagram illustrating a cooling system according to the embodiment of the invention. FIG. 2 is an enlarged view of an area of a storage part to be described later in FIG. 1. Additionally, in the description below, the X direction of FIG. 1 indicates the right and left direction of the cooling system (the +X direction indicates the left direction of the cooling system and the −X direction indicates the right direction of the cooling system), the Y direction of FIG. 1 indicates the front and rear direction of the cooling system (the +Y direction indicates the front direction of the cooling system and the −Y direction indicates the rear direction of the cooling system), and the Z direction of FIG. 2 indicates the up and down direction (the +Z direction indicates the up direction of the cooling system and the −Z direction indicates the down direction of the cooling system).

A cooling system 1 is a system for cooling a second refrigerant by using a first refrigerant and includes, as illustrated in FIG. 1, a first cooling system 10, a second cooling system 100, a third cooling system 200, and a control device 300 to be described later in FIG. 3. Here, the "first refrigerant" is used to cool the second refrigerant and is circulated by a circulation unit 50 to be described later. Further, the "second refrigerant" is cooled by the first refrigerant and is sent out by a delivery flow path 131 of the second cooling system 100 to be described later. Additionally, the first refrigerant corresponds to the "refrigerant" of claims and the second refrigerant corresponds to the "cooling object" of claims.

(Configuration-First Cooling System)

The first cooling system 10 is a system for exchanging heat of the first refrigerant with each of the second refrigerant and the third refrigerant and includes, as illustrated in FIG. 1, a compression unit 20, a storage part 30, a first heat exchange unit 41 to a sixth heat exchange unit 46, a first removing unit 47, a second removing unit 48, and a circulation unit 50. Here, the "third refrigerant" is used to cool the first refrigerant, is sent out by a first delivery flow path 201 or a second delivery flow path 202 of the third cooling system 200 to be described later, and is a basic concept including, for example, a gaseous refrigerant, a liquid refrigerant, and the like. However, in the embodiment, the third refrigerant will be described as industrial water.

(Configuration-First Cooling System-Compression Unit)

The compression unit 20 is a compression section which compresses the first refrigerant. The compression unit 20 is configured by using, for example, a known compressor (for example, a frequency-controlled operation type two-stage compressor such as a compressor having an inverter drive circuit) and the like and includes, specifically, a compression unit body 21, a first outlet 22, a first inlet 23, a second outlet 24, a second inlet 25, and a third inlet 26.

Among these, the compression unit body 21 is a basic structure of the compression unit 20 and is formed in a hollow shape. Further, the first outlet 22 is an opening for allowing the first refrigerant in the compression unit body 21 to flow out to a first circulation flow path 61 to be described later. Further, the first inlet 23 is an opening for allowing the first refrigerant in the first circulation flow path 61 to be described later to flow into the compression unit body 21. Further, the second outlet 24 is an opening for allowing the first refrigerant in the compression unit body 21 to flow out to a second circulation flow path 81 to be described later. Further, the second inlet 25 is an opening for allowing the first refrigerant in the second circulation flow path 81 to be described later to flow into the compression unit body 21. Further, the third inlet 26 is an opening for allowing the first refrigerant in an auxiliary pipe 62*c* to be described later (oil separated from a second removing unit 48 to be described later) to flow into the compression unit body 21.

Further, the specific operation content of the compression unit 20 is arbitrary, but is as follows in the embodiment. That is, first, the first refrigerant which flows from the first circulation flow path 61 to be described later into the compression unit body 21 through the first inlet 23 is compressed and the compressed first refrigerant flows out to the second circulation flow path 81 to be described later through the second outlet 24 (hereinafter, referred to as a "first compression operation"). Next, the first refrigerant flowing from the second circulation flow path 81 to be described later into the compression unit body 21 through the second inlet 25 is compressed and the compressed first refrigerant flows out to the first circulation flow path 61 to be described later through the first outlet 22 (hereinafter, referred to as a "second compression operation"). After that, an operation cycle including the first compression operation and the second compression operation is repeated. With such an operation, the first refrigerant which is compressed twice by the compression unit 20 can be allowed to flow out to the first circulation flow path 61 to be described later and the first refrigerant can be compressed efficiently compared to a case in which the compression operation is performed only once.

(Configuration-First Cooling System-Storage Part)

The storage part 30 is a storage section which stores the first refrigerant. The storage part 30 is configured by using, for example, a known refrigerant storage device (for example, a hollow columnar expansion tank having an inflow port (not illustrated) for allowing the first refrigerant to flow thereinto and therefrom) and is provided, as illustrated in FIG. 1, on the side of the second cooling system 100 in relation to the compression unit 20.

Further, the specific size (for example, diameter and height) of the storage part 30 is arbitrary, but may be set on the basis of, for example, a test result or the like since it is desirable to make the storage part 30 as small as possible as long as a desired amount of the first refrigerant can be stored.

(Configuration-First Cooling System-First Heat Exchange Unit to Sixth Heat Exchange Unit)

The first heat exchange unit 41 is a first heat exchange section which exchanges heat between the first refrigerant in the first circulation flow path 61 to be described later and the second refrigerant and is able to cool the second refrigerant. The first heat exchange unit 41 is configured by using, for example, a known heat exchanger (for example, an evaporator) or the like and is provided at a position in the vicinity of the second cooling system 100 (in FIG. 1, an upstream position of the delivery flow path 131 to be described later) as illustrated in FIG. 1.

The second heat exchange unit 42 is a second heat exchange section which exchanges heat between the first refrigerant in the first circulation flow path 61 to be described later and the second refrigerant and is able to heat the second refrigerant cooled by the first heat exchange unit 41. The second heat exchange unit 42 is configured by using, for example, a known heat exchanger (for example, a plate heat exchanger) or the like and is provided at a position in the vicinity of the second cooling system 100 (in FIG. 1, a downstream position of the delivery flow path 131 to be described later) as illustrated in FIG. 1. Such a second heat exchange unit 42 can heat the second refrigerant cooled too much by the first heat exchange unit 41 and can easily maintain the temperature of the downstream part of the delivery flow path 131 to be described later at a desired temperature. Additionally, the "first heat exchange unit 41" and the "second heat exchange unit 42" correspond to the "heat exchange section" of claims.

The third heat exchange unit 43 is a third heat exchange section which exchange heat between the first refrigerant in the first circulation flow path 61 to be described later and the third refrigerant and is able to cool the first refrigerant. The third heat exchange unit 43 is configured by using, for example, a known heat exchanger or the like and is provided at a position in the vicinity of the third cooling system 200 as illustrated in FIG. 1.

The fourth heat exchange unit 44 is a fourth heat exchange section which exchanges heat between the first refrigerant in the second circulation flow path 81 to be described later and the third refrigerant and is able to cool the first refrigerant. The fourth heat exchange unit 44 is configured by using, for example, a known heat exchanger or the like and is provided at a position in the vicinity of the third cooling system 200 (in FIG. 1, a position different from the third heat exchange unit 43) as illustrated in FIG. 1.

The fifth heat exchange unit 45 is a fifth heat exchange section which exchanges heat between the first refrigerant in the upstream part in relation to the first heat exchange unit 41 in a first cooling object side pipe 63*a* to be described later and the first refrigerant in a sixth sub-pipe 71*f* to be described later and is able to cool the first refrigerant in the first cooling object side pipe 63*a* to be described later. The fifth heat exchange unit 45 is configured by using, for example, a known heat exchanger or the like and is provided between the second heat exchange unit 42 and the third heat exchange unit 43 as illustrated in FIG. 1. Such a fifth heat exchange unit 45 can cool (supercool) the first refrigerant in the upstream part in relation to the first heat exchange unit 41 in the first cooling object side pipe 63*a* to be described later and can improve the cooling efficiency of the cooling system 1 while promoting the cooling of the second refrigerant compared to a case in which the fifth heat exchange unit 45 is not provided.

The sixth heat exchange unit 46 is a refrigerant heat exchange section which exchanges heat between the first refrigerant in the upstream part in relation to the first heat exchange unit 41 in the first cooling object side pipe 63*a* to be described later and the first refrigerant in the downstream part in relation to the second heat exchange unit 42 in the second cooling object side pipe 63*b* to be described later and is able to heat the first refrigerant in the second cooling object side pipe 63*b* to be described later. The sixth heat exchange unit 46 is configured by using, for example, a known heat exchanger or the like and is provided between the storage part 30 and the first heat exchange unit 41 (or the second heat exchange unit 42) as illustrated in FIG. 1. Such a sixth heat exchange unit 46 can increase the temperature of the first refrigerant in the downstream part in relation to the second heat exchange unit 42 in the second cooling object side pipe 63*b* to be described later and can allow the dry first refrigerant to flow into the compression unit 20.

(Configuration-First Cooling System-First Removing Unit)

The first removing unit 47 is a first removing section which removes foreign matter (for example, shred, dust, or the like), moisture, or the like contained in the first refrigerant in the first circulation flow path 61 to be described later. The first removing unit 47 is configured by using, for example, a known refrigerant removing device (for example, a filter dryer) or the like and is provided between the third heat exchange unit 43 and the fifth heat exchange unit 45 as illustrated in FIG. 1.

(Configuration-First Cooling System-Second Removing Unit)

The second removing unit 48 is a second removing section which removes foreign matter (for example, oil or the like) contained in the first refrigerant in the first circulation flow path 61 to be described later. The second removing unit 48 is configured by using, for example, a known oil separator or the like and is provided between the compression unit 20 and the storage part 30 as illustrated in FIG. 1.

(Configuration-First Cooling System-Circulation Unit)

The circulation unit 50 is a circulation section for circulating the first refrigerant and includes a first circulation unit 60 and a second circulation unit 80 as illustrated in FIG. 1.

(Configuration-First Cooling System-Circulation Unit-First Circulation Unit)

The first circulation unit 60 is for circulating the first refrigerant toward the second cooling system 100 and includes, as illustrated in FIG. 1, a first circulation flow path 61, a first sub-pipe 71*a* to a sixth sub-pipe 71*f*, a first opening and closing valve 72*a* to an eighth opening and closing valve 72*h*, a temperature detection unit 73, a first pressure detection unit 74*a* to a third pressure detection unit 74*c*, a first discharge valve 75*a*, and a second discharge valve 75*b*.

(Configuration-First Cooling System-Circulation Unit-First Circulation Unit-First Circulation Flow Path)

The first circulation flow path 61 is a circulation flow path for circulating the first refrigerant so as to exchange heat between the first refrigerant compressed by the compression unit 20 and the second refrigerant. The first circulation flow path 61 is configured by using, for example, a known closed circulation flow path and is provided so as to pass through the compression unit 20, the second removing unit 48, the storage part 30, the first heat exchange unit 41 to the sixth heat exchange unit 46, and the first removing unit 47 as illustrated in FIG. 1. Further, as illustrated in FIG. 1, the first circulation flow path 61 includes a compression unit side pipe 62 and a cooling object side pipe 63.

(Configuration-First Cooling System-Circulation Unit-First Circulation Unit-First Circulation Flow Path-Compression Unit Side Pipe)

The compression unit side pipe 62 is a pipe which is located on the side of the compression unit 20 among the pipes constituting the first circulation flow path 61. The compression unit side pipe 62 is configured by using, for example, a known refrigerant pipe or the like (additionally, the same applies to the configuration of other pipes) and includes, as illustrated in FIG. 1, an outlet side pipe 62*a*, an inlet side pipe 62*b*, and an auxiliary pipe 62*c*.

The outlet side pipe 62*a* is a pipe which is located on the side of the first outlet 22 of the compression unit 20 and is connected to the first outlet 22 of the compression unit 20 and the upstream end portion of the cooling object side pipe 63. Specifically, as illustrated in FIG. 1, the outlet side pipe 62*a* is connected so that the entire outlet side pipe is located outside the storage part 30.

The inlet side pipe 62*b* is a pipe which is located on the side of the first inlet 23 of the compression unit 20 and is connected to, as illustrated in FIG. 1, the first inlet 23 of the compression unit 20 and the downstream end portion of the cooling object side pipe 63.

The auxiliary pipe 62*c* is a pipe which is located on the side of the third inlet 26 of the compression unit 20 and is connected to, as illustrated in FIG. 1, the third inlet 26 of the compression unit 20 and the second removing unit 48. Further, the auxiliary pipe 62*c* is provided with an auxiliary valve 62*d* for switching whether or not to allow the oil in the auxiliary pipe 62*c* to flow into the compression unit body 21 (for example, a known opening and closing valve such as a solenoid valve).

(Configuration-First Cooling System-Circulation Unit-First Circulation Unit-First Circulation Flow Path-Cooling Object Side Pipe)

The cooling object side pipe 63 is a pipe which is located on the side of the second cooling system 100 (the side of the cooling object) among the pipes constituting the first circulation flow path 61 and includes, as illustrated in FIG. 1, a first cooling object side pipe 63*a* and a second cooling object side pipe 63*b*.

The first cooling object side pipe 63*a* is a pipe which is located on the side of the first heat exchange unit 41 and is connected to the downstream end portion of the outlet side pipe 62*a* and the upstream end portion of the inlet side pipe 62*b*. Specifically, as illustrated in FIG. 1, the first cooling object side pipe is connected to sequentially pass through the sixth heat exchange unit 46, the third heat exchange unit 43, the first removing unit 47, the fifth heat exchange unit 45, the first heat exchange unit 41, and the sixth heat exchange unit 46.

The second cooling object side pipe 63*b* is a pipe which is located on the side of the second heat exchange unit 42 and is connected to the downstream end portion of the outlet side pipe 62*a* and the upstream end portion of the inlet side pipe 62*b*. Specifically, as illustrated in FIG. 1, the second cooling object side pipe is connected to sequentially pass through the second heat exchange unit 42 and the sixth heat exchange unit 46. Additionally, in the embodiment, as illustrated in FIG. 1, the downstream part of the second cooling object side pipe 63*b* (specifically, a part extending from the downstream end portion of the second cooling object side pipe 63*b* to the upstream side of the sixth heat exchange unit 46) is integrally formed with the downstream part of the first cooling object side pipe 63*a* so as to also serve as the downstream part of the first cooling object side pipe 63*a*.

Further, the flow of the first refrigerant in the first circulation flow path 61 is as follows.

That is, first, a part of the first refrigerant compressed by the compression unit 20 flows out to the first cooling object side pipe 63*a* through the outlet side pipe 62*a*. Next, the first refrigerant flowing out to the first cooling object side pipe 63*a* is cooled by the third heat exchange unit 43 and the fifth heat exchange unit 45 and exchanges heat with the second refrigerant by the first heat exchange unit 41 (specifically, heat exchange is performed to cool the second refrigerant). Then, the first refrigerant exchanging heat with the second refrigerant is heated by the sixth heat exchange unit 46 and flows into the compression unit 20 through the first cooling object side pipe 63*a* and the inlet side pipe 62*b*. Further, the other part of the first refrigerant compressed by the compression unit 20 flows out to the second cooling object side pipe 63*b* through the outlet side pipe 62*a*. Next, the first refrigerant flowing out to the second cooling object side pipe 63*b* exchanges heat with the second refrigerant by the second heat exchange unit 42 (specifically, heat exchange is performed to heat the second refrigerant). Then, the first refrigerant exchanging heat with the second refrigerant is heated by the sixth heat exchange unit 46 and flows into the compression unit 20 through the second cooling object side pipe 63*b* and the inlet side pipe 62*b*.

Such a first circulation flow path 61 can circulate the first refrigerant so as to exchange heat between the first refrigerant in the first circulation flow path 61 and the second refrigerant in the delivery flow path 131 to be described later.

(Configuration-First Cooling System-Circulation Unit-First Circulation Unit-First Sub-Pipe to Sixth Sub-Pipe)

The first sub-pipe 71*a* is a first pipe for allowing the first refrigerant in the outlet side pipe 62*a* to flow into the storage part 30 through the first sub-pipe 71*a*. The first sub-pipe 71*a* is connected to the outlet side pipe 62*a*. Specifically, as illustrated in FIG. 1, the upstream end portion of the first sub-pipe 71*a* is connected to the upstream part in relation to the storage part 30 in the outlet side pipe 62*a* and the downstream end portion of the first sub-pipe 71*a* is accommodated inside the storage part 30. Such a first sub-pipe 71*a* can allow the first refrigerant in the outlet side pipe 62*a* to flow into the storage part 30 and prevent an excessive pressure in the first circulation flow path 61. Particularly, since the first sub-pipe 71*a* is connected to the outlet side pipe 62*a*, it is possible to effectively prevent an excessive pressure in the first circulation flow path 61 compared to a case in which the first sub-pipe 71*a* is connected to the inlet side pipe 62*b*. Further, since the temperature in the storage part 30 can be easily maintained at a critical temperature or more of the first refrigerant (for example, 31° C. or more or the like) due to the heat of the first refrigerant flowing into the storage part 30, it is possible to suppress a decrease in the amount of the refrigerant in the first circulation flow path 61 due to the condensation of the first refrigerant in the storage part 30.

The second sub-pipe 71*b* is a second pipe for allowing the first refrigerant in the storage part 30 to flow into the inlet side pipe 62*b* through the second sub-pipe 71*b*. The second sub-pipe 71*b* is connected to the inlet side pipe 62*b*. Specifically, as illustrated in FIG. 1, the upstream end portion of the second sub-pipe 71*b* is connected to the upstream part in relation to the compression unit 20 in the inlet side pipe 62*b* and the downstream end portion of the second sub-pipe 71*b* is accommodated in the storage part 30. Additionally, in the embodiment, as illustrated in FIG. 1, a part on the side of the storage part 30 in the second sub-pipe 71*b* is integrally formed with a part on the side of the storage part 30 in the first sub-pipe 71*a* so as to also serve as a part on the side of the storage part 30 in the first sub-pipe 71*a*. However, the invention is not limited thereto and, for example, the second sub-pipe may be formed separately from a part on the side of the storage part 30 in the first sub-pipe 71*a*. Since such a second sub-pipe 71*b* can allow the first refrigerant (the surplus first refrigerant) in the storage part 30 to flow into the inlet side pipe 62*b* and can increase the temperature in the inlet side pipe 62*b* due to the heat of the inflowing first refrigerant, it is possible to suppress the functional deterioration or failure of the compression unit 20 due to the inflow of saturated steam into the compression unit 20.

The third sub-pipe 71*c* is a third pipe which transfers the heat of the third sub-pipe 71*c* lower than the heat of the outlet side pipe 62*a* (specifically, the cold heat of the third sub-pipe 71*c* cooled by the first refrigerant in the third sub-pipe 71*c*) to the first refrigerant in the storage part 30 and is connected to the inlet side pipe 62*b* (specifically, a part on the side of the compression unit 20 in the inlet side pipe 62*b*).

Further, the method of forming the third sub-pipe 71*c* is arbitrary, but in the embodiment, the third sub-pipe 71*c* is formed so that heat thereof can be transferred to the first refrigerant in the storage part 30. Specifically, as illustrated in FIG. 1, a part of the third sub-pipe 71*c* is bent in a substantially U shape so that a part of the third sub-pipe 71*c* is accommodated in the storage part 30. However, the invention is not limited thereto and, for example, the third sub-pipe may be formed by bending a part of the third pipe in a coil shape so that a part of the third pipe outside the storage part 30 is wound around the storage part 30.

The fourth sub-pipe 71*d* is a fourth pipe which transfers the heat of the fourth sub-pipe 71*d* higher than the heat of the third sub-pipe 71*c* (specifically, the warm heat of the third sub-pipe 71*c* heated by the first refrigerant in the fourth sub-pipe 71*d*) to the first refrigerant in the storage part 30 and is connected to the outlet side pipe 62*a* (specifically, the downstream part in relation to the second removing unit 48 in the outlet side pipe 62*a*).

Further, the method of forming the fourth sub-pipe 71*d* is arbitrary, but in the embodiment, the fourth sub-pipe 71*d* is formed so that heat thereof can be transferred to the first refrigerant in the storage part 30. Specifically, as illustrated in FIG. 1, a part of the fourth sub-pipe 71*d* is bent in a substantially U shape so that a part of the fourth sub-pipe 71*d* is accommodated in the storage part 30. However, the invention is not limited thereto and, for example, a part of the fourth sub-pipe 71*d* may be bent in a coil shape so that a part of the fourth sub-pipe 71*d* outside the storage part 30 is wound around the storage part 30.

The fifth sub-pipe 71*e* is a fifth pipe for allowing the first refrigerant in the first cooling object side pipe 63*a* to flow into the inlet side pipe 62*b* and is connected to the first cooling object side pipe 63*a* and the inlet side pipe 62*b*. Specifically, as illustrated in FIG. 1, the fifth sub-pipe is connected to the upstream part in relation to the first heat exchange unit 41 in the first cooling object side pipe 63*a* and the upstream end portion of the inlet side pipe 62*b*. Such a fifth sub-pipe 71*e* can allow the first refrigerant in the upstream part in relation to the first heat exchange unit 41 in the first cooling object side pipe 63*a* to flow into the inlet side pipe 62*b* and can adjust the temperature of the first refrigerant in the first circulation flow path 61 by using the heat of the inflowing first refrigerant.

The sixth sub-pipe 71*f* is a sixth pipe which is located on the side of the fifth heat exchange unit 45 and is connected to the fourth sub-pipe 71*d*, the first cooling object side pipe 63*a*, and the third sub-pipe 71*c* so as to pass through the sixth heat exchange unit 46. Specifically, as illustrated in FIG. 1, the upstream end portion of the sixth sub-pipe 71*f* is connected to the upstream part in relation to the storage part 30 in the fourth sub-pipe 71*d* and the downstream end portion of the sixth sub-pipe 71*f* is connected to the upstream end portion of the third sub-pipe 71*c*. Such a sixth sub-pipe 71*f* can exchange heat between the first refrigerant in the sixth sub-pipe 71*f* and the first refrigerant in the first cooling object side pipe 63*a*.

Here, the specific configuration of the first sub-pipe 71*a* and the second sub-pipe 71*b* is arbitrary, but in the embodiment, the configuration is as follows.

That is, since the first sub-pipe 71*a* and the second sub-pipe 71*b* are formed so that a part of each of the first sub-pipe 71*a* and the second sub-pipe 71*b* is located above the other part, it is possible to prevent the first refrigerant in the storage part 30 from reversely flowing to the outlet side pipe 62*a* or the inlet side pipe 62*b* through the first sub-pipe 71*a* or the second sub-pipe 71*b*. Specifically, as illustrated in FIG. 2, the first sub-pipe 71*a* and the second sub-pipe 71*b* are bent so that a part accommodated in the storage part 30 in each of the first sub-pipe 71*a* and the second sub-pipe 71*b* and a part in the vicinity thereof are located above the other parts (more specifically, a front end portion of a part accommodated in the storage part 30 is located in the vicinity of the upper end of the storage part 30 and is located above the third sub-pipe 71*c* and the fourth sub-pipe 71*d*). Accordingly, since the density of the first refrigerant in the storage part 30 becomes much larger than the density of the first refrigerant in the first sub-pipe 71*a* and the second sub-pipe 71*b* when cooling the storage part 30, it is possible to prevent the first refrigerant in the storage part 30 from reversely flowing to the outlet side pipe 62*a* or the inlet side pipe 62*b* through the first sub-pipe 71*a* or the second sub-pipe 71*b* due to gravity and to accurately manage the amount of the first refrigerant in the first circulation flow path 61.

Further, as illustrated in FIG. 2, the first sub-pipe 71*a* is provided with an inflow preventing portion 76. The inflow preventing portion is an inflow preventing section which prevents foreign matter (for example, oil or the like) from flowing into the storage part 30 through the first sub-pipe 71*a*, is configured as a through-hole formed in the side portion of the first sub-pipe 71*a*, and is provided in a part accommodated in the storage part 30 in the first sub-pipe 71*a* (specifically, a lower end part of the corresponding part). Accordingly, foreign matter can be discharged to the outside of the first sub-pipe 71*a* through the inflow preventing portion 76 when the first refrigerant flows into the storage part 30 through the first sub-pipe 71*a*. Thus, it is possible to prevent foreign matter from flowing into the storage part 30 through the first sub-pipe 71*a* and to prevent the first refrigerant in the storage part 30 from being contaminated by foreign matter.

(Configuration-First Cooling System-Circulation Unit-First Circulation Unit-First Opening and Closing Valve to Eighth Opening and Closing Valve)

Returning to FIG. 1, the first opening and closing valve 72*a* is a valve for switching whether or not to allow the first refrigerant in the outlet side pipe 62*a* to flow into the storage part 30. The first opening and closing valve 72*a* is configured by using, for example, a known opening and closing valve (for example, a solenoid valve) or the like (additionally, the same applies to the configuration of other opening and closing valves) and is provided in the first sub-pipe 71*a*. Specifically, as illustrated in FIG. 1, the first opening and closing valve is connected to a part on the side of the compression unit 20 in the first sub-pipe 71*a*.

The second opening and closing valve 72*b* is a valve for switching whether or not to allow the first refrigerant in the storage part 30 to flow into the inlet side pipe 62*b* and is provided in the second sub-pipe 71*b*. Specifically, as illustrated in FIG. 1, the second opening and closing valve is connected to a part on the side of the compression unit 20 in the second sub-pipe 71*b*.

The third opening and closing valve 72*c* is a valve for switching whether or not to allow the first refrigerant in the upstream part in relation to the storage part 30 in the third sub-pipe 71*c* to flow into a part on the side of the storage part 30 in the third sub-pipe 71*c* and is provided in the third sub-pipe 71*c*. Specifically, as illustrated in FIG. 1, the third opening and closing valve is connected to a part between the upstream end portion of the third sub-pipe 71*c* and the storage part 30.

The fourth opening and closing valve 72*d* is a valve for switching whether or not to allow the first refrigerant in the upstream part in relation to the storage part 30 in the fourth sub-pipe 71*d* to flow into a part on the side of the storage part 30 in the fourth sub-pipe 71*d* and is provided in the fourth sub-pipe 71*d*. Specifically, as illustrated in FIG. 1, the fourth opening and closing valve is connected to a part between the upstream end portion of the fourth sub-pipe 71*d* and the storage part 30.

The fifth opening and closing valve 72*e* is a valve for adjusting the amount of the first refrigerant in the cooling object side pipe 63 flowing into the inlet side pipe 62*b* and is provided in the fifth sub-pipe 71*e*. Specifically, as illustrated in FIG. 1, the fifth opening and closing valve is connected to the upstream part of the fifth sub-pipe 71*e*.

The sixth opening and closing valve 72*f* is a valve for adjusting the amount of the first refrigerant in the first cooling object side pipe 63*a* flowing into the first heat exchange unit 41 and is provided in the first cooling object side pipe 63*a*. Specifically, as illustrated in FIG. 1, the sixth opening and closing valve is connected to a part between the first heat exchange unit 41 of the first cooling object side pipe 63*a* and the fifth heat exchange unit 45.

The seventh opening and closing valve 72*g* is a valve for adjusting the amount of the first refrigerant exchanging heat by the second heat exchange unit 42 and flowing into the inlet side pipe 62*b* and is provided in the second cooling object side pipe 63*b*. Specifically, as illustrated in FIG. 1, the seventh opening and closing valve is connected to the downstream part in relation to the first heat exchange unit 41 in the second cooling object side pipe 63*b*.

The eighth opening and closing valve 72*h* is a valve for adjusting the amount of the first refrigerant in the upstream part in relation to the fifth heat exchange unit 45 in the sixth sub-pipe 71*f* flowing into the downstream part in relation to the fifth heat exchange unit 45 in the sixth sub-pipe 71*f* and is provided in the sixth sub-pipe 71*f*. Specifically, as illustrated in FIG. 1, the eighth opening and closing valve is connected to the upstream part of the sixth sub-pipe 71*f*.

(Configuration-First Cooling System-Circulation Unit-First Circulation Unit-Temperature Detection Unit)

The temperature detection unit 73 is a detection section which detects the temperature in the outlet side pipe 62*a*. The temperature detection unit 73 is configured by using, for example, a known temperature detection sensor or the like (additionally, the same applies to the configuration of other temperature detection units) and is provided in the outlet side pipe 62*a*. Specifically, as illustrated in FIG. 1, the temperature detection unit is connected to a part in the vicinity of the compression unit 20 in the outlet side pipe 62*a*.

(Configuration-First Cooling System-Circulation Unit-First Circulation Unit-First Pressure Detection Unit to Third Pressure Detection Unit)

The first pressure detection unit 74*a* is used to detect the pressure in the outlet side pipe 62*a*. The first pressure detection unit 74*a* is configured by using, for example, a known pressure sensor, pressure switch, or the like and is provided in the outlet side pipe 62*a* at a plurality of positions (in FIG. 1, two positions). Specifically, as illustrated in FIG. 1, the first pressure detection unit is connected to a part in the vicinity of the compression unit 20 in the outlet side pipe 62*a*.

The second pressure detection unit 74*b* is used to detect the pressure in the inlet side pipe 62*b*. The second pressure detection unit 74*b* is configured by using, for example, a known pressure sensor or the like (additionally, the same applies to the third pressure detection unit 74*c*, a pressure detection unit 82 to be described later, and a delivery pressure detection unit 136 to be described later) and is provided in the inlet side pipe 62*b*. Specifically, as illustrated in FIG. 1, the second pressure detection unit is connected to a part in the vicinity of the compression unit 20 in the inlet side pipe 62*b*.

The third pressure detection unit 74*c* is used to detect the pressure in the cooling object side pipe 63 and is provided in the first cooling object side pipe 63*a*. Specifically, as illustrated in FIG. 1, the third pressure detection unit is connected to a part between the fifth heat exchange unit 45 in the first cooling object side pipe 63*a* and the sixth opening and closing valve 72*f*

(Configuration-First Cooling System-Circulation Unit-First Circulation Unit-First Discharge Valve, Second Discharge Valve)

The first discharge valve 75*a* is a valve for switching whether or not to discharge the first refrigerant in the outlet side pipe 62*a* to the first discharge part (not illustrated) and is provided in the outlet side pipe 62*a* as illustrated in FIG. 1.

The second discharge valve 75*b* is a valve for switching whether or not to discharge the first refrigerant in the inlet side pipe 62*b* to the second discharge part (not illustrated) and is provided in the inlet side pipe 62*b* as illustrated in FIG. 1.

(Configuration-First Cooling System-Circulation Unit-Second Circulation Unit)

The second circulation unit 80 is for circulating the first refrigerant toward the second cooling system 100 and includes, as illustrated in FIG. 1, a second circulation flow path 81 and the pressure detection unit 82.

(Configuration-First Cooling System-Circulation Unit-Second Circulation Unit-Second Circulation Flow Path)

The second circulation flow path 81 is a flow path for circulating the first refrigerant so as to exchange heat between the first refrigerant compressed by the compression unit 20 and the third refrigerant. The second circulation flow path 81 is configured by using, for example, a known closed circulation flow path configured as a pipe and is provided so as to pass through the fourth heat exchange unit 44 as illustrated in FIG. 1. Such a second circulation flow path 81 can circulate the first refrigerant so as to exchange heat between the first refrigerant in the second circulation flow path 81 and the third refrigerant in the first delivery flow path 201 to be described later.

(Configuration-First Cooling System-Circulation Unit-Second Circulation Unit-Pressure Detection Unit)

The pressure detection unit 82 is used to detect the pressure in the second circulation flow path 81 and is provided in the second circulation flow path 81. Specifically, as illustrated in FIG. 1, the pressure detection unit is connected to the downstream part in the second circulation flow path 81.

(Configuration-Second Cooling System)

The second cooling system 100 is a system for exchanging heat of the second refrigerant with the first refrigerant and includes, as illustrated in FIG. 1, an air vent unit 110, a storage part 120, and a delivery unit 130.

(Configuration-Second Cooling System-Air Vent Unit)

The air vent unit 110 is used to discharge air accumulated in the delivery flow path 131 to be described later and is configured by using, for example, a known air venter (for example, an air vent tank) or the like. As illustrated in FIG. 1, the air vent unit is provided in the vicinity of the second heat exchange unit 42.

(Configuration-Second Cooling System-Storage Part)

The storage part 120 is used to store the second refrigerant and is configured by using, for example, a known refrigerant storage section (for example, a reservoir tank with an auxiliary tank 121 (or a reservoir tank without an auxiliary tank 121)) or the like. As illustrated in FIG. 1, the storage part is provided in the vicinity of the delivery flow path 131.

(Configuration-Second Cooling System-Delivery Unit)

The delivery unit 130 is a delivery section for sending the second refrigerant toward the first cooling system 10 and includes, as illustrated in FIG. 1, the delivery flow path 131, a first sub-delivery pipe 132*a* to a fifth sub-delivery pipe 132*e*, a first delivery opening and closing valve 133*a* to a fifth delivery opening and closing valve 133*e*, a pump unit 134, a first delivery temperature detection unit 135*a* to a third delivery temperature detection unit 135*c*, the delivery pressure detection unit 136, a flow rate detection unit 137, and a level detection unit 138.

(Configuration-Second Cooling System-Delivery Unit-Delivery Flow Path)

The delivery flow path 131 is a flow path for sending the second refrigerant toward the first cooling system 10. The delivery flow path 131 is configured by using, for example, a known flow path configured as a pipe (additionally, the same applies to the configuration of other delivery flow paths) and is provided so as to pass through a first inflow portion (not illustrated) which allows the second refrigerant to flow from the outside into the delivery flow path 131, the first heat exchange unit 41, the second heat exchange unit 42, the air vent unit 110, and a first outflow portion (not illustrated) which allows the second refrigerant to flow from the delivery flow path 131 to the outside as illustrated in FIG. 1. Specifically, the upstream end portion of the delivery flow path 131 is connected to the first inflow portion and the downstream end portion of the delivery flow path 131 is connected to the first outflow portion. Such a delivery flow path 131 can send the second refrigerant so as to exchange heat between the second refrigerant in the delivery flow path 131 and the first refrigerant in the first circulation flow path 61.

(Configuration-Second Cooling System-Delivery Unit-First Sub-Delivery Pipe to Fifth Sub-Delivery Pipe)

The first sub-delivery pipe 132*a* is a pipe for allowing the second refrigerant in the air vent unit 110 to flow into the storage part 120 through the first sub-delivery pipe 132*a*. As illustrated in FIG. 1, the upstream end portion of the first sub-delivery pipe 132*a* is connected to the air vent unit 110 and the downstream end portion of the first sub-delivery pipe 132*a* is connected to the storage part 120.

The second sub-delivery pipe 132*b* is a pipe for allowing the second refrigerant in the storage part 120 to flow into the air vent unit 110 through the second sub-delivery pipe 132*b*. As illustrated in FIG. 1, the upstream end portion of the second sub-delivery pipe 132*b* is connected to the storage part 120 and the downstream end portion of the second sub-delivery pipe 132*b* is connected to the air vent unit 110.

The third sub-delivery pipe 132*c* is a pipe for allowing the second refrigerant in the upstream part of the delivery flow path 131 to flow into the downstream part of the delivery flow path 131 through the third sub-delivery pipe 132*c*. As illustrated in FIG. 1, the upstream end portion of the third sub-delivery pipe 132*c* is connected to the upstream part of the delivery flow path 131 and the downstream end portion of the third sub-delivery pipe 132*c* is connected to the downstream part of the delivery flow path 131.

The fourth sub-delivery pipe 132*d* is a pipe for discharging the second refrigerant in the delivery flow path 131 to a third discharge part (not illustrated) through the fourth sub-delivery pipe 132*d*. As illustrated in FIG. 1, the upstream end portion of the fourth sub-delivery pipe 132*d* is connected to a part on the side of the first heat exchange unit 41 in the delivery flow path 131 and the downstream end portion of the fourth sub-delivery pipe 132*d* is connected to the third discharge part.

The fifth sub-delivery pipe 132*e* is a pipe for discharging the second refrigerant in the air vent unit 110 to a fourth discharge part (not illustrated) through the fifth sub-delivery pipe 132*e*. As illustrated in FIG. 1, the upstream end portion of the fifth sub-delivery pipe 132*e* is connected to the downstream part of the delivery flow path 131 and the downstream end portion of the fourth sub-delivery pipe 132*d* is connected to the fourth discharge part.

(Configuration-Second Cooling System-Delivery Unit-First Delivery Opening and Closing Valve to Fifth Delivery Opening and Closing Valve)

The first delivery opening and closing valve 133*a* is a valve for switching whether or not to allow the second refrigerant to flow from the first inflow portion into the delivery flow path 131. The first delivery opening and closing valve 133*a* is configured by using, for example, a known opening and closing valve (for example, a gate valve) or the like (additionally, the same applies to the configuration of the second delivery opening and closing valve 133*b*) and is provided in the upstream end portion of the delivery flow path 131 as illustrated in FIG. 1.

The second delivery opening and closing valve 133*b* is a valve for switching whether or not to allow the second refrigerant to flow out from the delivery flow path 131 to the first outflow portion and is provided in the downstream end portion of the delivery flow path 131 as illustrated in FIG. 1.

The third delivery opening and closing valve 133*c* is a valve for switching whether or not to allow the second refrigerant in the third sub-delivery pipe 132*c* to flow into the downstream part of the delivery flow path 131. The third delivery opening and closing valve 133*c* is configured by using, for example, a known opening and closing valve (for example, a ball valve) or the like (additionally, the same applies to the configuration of the fourth delivery opening and closing valve 133*d*) and is provided in the third sub-delivery pipe 132*c* as illustrated in FIG. 1.

The fourth delivery opening and closing valve 133*d* is a valve for switching whether or not to discharge the second refrigerant in the fourth sub-delivery pipe 132*d* to the third discharge part and is provided in the fourth sub-delivery pipe 132*d* as illustrated in FIG. 1.

The fifth delivery opening and closing valve 133*e* is a valve for switching whether or not to discharge the second refrigerant in the fifth sub-delivery pipe 132*e* to the fourth discharge part and is provided in the fifth sub-delivery pipe 132*e* as illustrated in FIG. 1.

(Configuration-Second Cooling System-Delivery Unit-Pump Unit)

The pump unit 134 is used to send the second refrigerant in the delivery flow path 131 from the first inflow portion toward the first outflow portion, is configured by using, for example, a known pump or the like, and is provided in the downstream part of the delivery flow path 131 as illustrated in FIG. 1.

(Configuration-Second Cooling System-Delivery Unit-First Delivery Temperature Detection Unit to Third Delivery Temperature Detection Unit)

The first delivery temperature detection unit 135*a* is used to detect the temperature in the delivery flow path 131 and is provided in the upstream part of the delivery flow path 131 as illustrated in FIG. 1.

The second delivery temperature detection unit 135*b* is used to detect the temperature in the delivery flow path 131 and is provided in a part on the side of the first heat exchange unit 41 in the delivery flow path 131 as illustrated in FIG. 1.

The third delivery temperature detection unit 135*c* is used to detect the temperature in the delivery flow path 131 and is provided in the downstream part of the delivery flow path 131 as illustrated in FIG. 1.

(Configuration-Second Cooling System-Delivery Unit-Delivery Pressure Detection Unit)

The delivery pressure detection unit 136 is used to detect the pressure in the delivery flow path 131 and is provided in the downstream part of the delivery flow path 131 as illustrated in FIG. 1.

(Configuration-Second Cooling System-Delivery Unit-Flow Rate Detection Unit)

The flow rate detection unit 137 is used to detect the flow rate of the second refrigerant in the delivery flow path 131, is configured by using, for example, a known flow rate detection sensor or the like, and is provided in the downstream part of the delivery flow path 131 as illustrated in FIG. 1.

(Configuration-Second Cooling System-Delivery Unit-Level Detection Unit)

The level detection unit 138 is used to detect the height of the liquid level of the storage part 120, is configured by using, for example, a known level detection sensor or the like, and is provided in the first sub-delivery pipe 132*a* as illustrated in FIG. 1.

(Configuration-Third Cooling System)

The third cooling system 200 is a system for exchanging heat of the third refrigerant with the first refrigerant and includes, as illustrated in FIG. 1, the first delivery flow path 201, the second delivery flow path 202, a sixth delivery opening and closing valve 203 to an eighth delivery opening and closing valve 205, a delivery temperature detection unit 206, and a removing unit 207.

(Configuration-Third Cooling System-Delivery Flow Path)

The first delivery flow path 201 is a flow path for sending the third refrigerant toward the first cooling system 10 and is provided so as to pass through a second inflow portion (not illustrated) which allows the third refrigerant to flow from the outside into the first delivery flow path 201, the third heat exchange unit 43, and a second outflow portion (not illustrated) which allows the third refrigerant to flow from the first delivery flow path 201 to the outside as illustrated in FIG. 1. Specifically, the upstream end portion of the first delivery flow path 201 is connected to the second inflow portion and the downstream end portion of the first delivery flow path 201 is connected to the second outflow portion. Such a first delivery flow path 201 can send the third refrigerant so as to exchange heat between the third refrigerant in the first delivery flow path 201 and the first refrigerant in the first circulation flow path 61.

The second delivery flow path 202 is a flow path for sending the third refrigerant toward the first cooling system 10 and is provided so as to pass through the fourth heat exchange unit 44 as illustrated in FIG. 1. Specifically, the upstream end portion of the second delivery flow path 202 is connected to the upstream part of the first delivery flow path 201 and the downstream end portion of the second delivery flow path 202 is connected to the downstream part of the first delivery flow path 201. Such a second delivery flow path 202 can send the third refrigerant so as to exchange heat between the third refrigerant in the second delivery flow path 202 and the first refrigerant in the second circulation flow path 81.

(Configuration-Third Cooling System-Sixth Delivery Opening and Closing Valve to Eighth Delivery Opening and Closing Valve)

The sixth delivery opening and closing valve 203 is a valve for switching whether or not to allow the third refrigerant in the first delivery flow path 201 to flow out to the second outflow portion. The sixth delivery opening and closing valve 203 is configured by using, for example, a known opening and closing valve (for example, a water control valve) or the like and is provided in the downstream part of the first delivery flow path 201 as illustrated in FIG. 1.

The seventh delivery opening and closing valve 204 is a valve for switching whether or not to allow the third refrigerant in the second delivery flow path 202 to flow out to the second outflow portion. The seventh delivery opening and closing valve 204 is configured by using, for example, a known opening and closing valve (for example, a solenoid valve) or the like and is provided in the downstream part of the second delivery flow path 202 as illustrated in FIG. 1.

The eighth delivery opening and closing valve 205 is a valve for adjusting the third refrigerant in the first delivery flow path 201. The eighth delivery opening and closing valve 205 is configured by using, for example, a known opening and closing valve (for example, a constant flow control valve) or the like and is provided in the upstream part of the second delivery flow path 202 as illustrated in FIG. 1.

(Configuration-Third Cooling System-Delivery Temperature Detection Unit)

The delivery temperature detection unit 206 is used to detect the temperature in the first delivery flow path 201 and is provided in the upstream part of the first delivery flow path 201 as illustrated in FIG. 1.

(Configuration-Third Cooling System-Removing Unit)

The removing unit 207 is a removing section for removing foreign matter contained in the third refrigerant in the first delivery flow path 201. The removing unit 207 is configured by using, for example, a known filtering device or the like and is provided in the upstream part of the first delivery flow path 201 as illustrated in FIG. 1.

(Configuration-Control Device)

Figure 3:
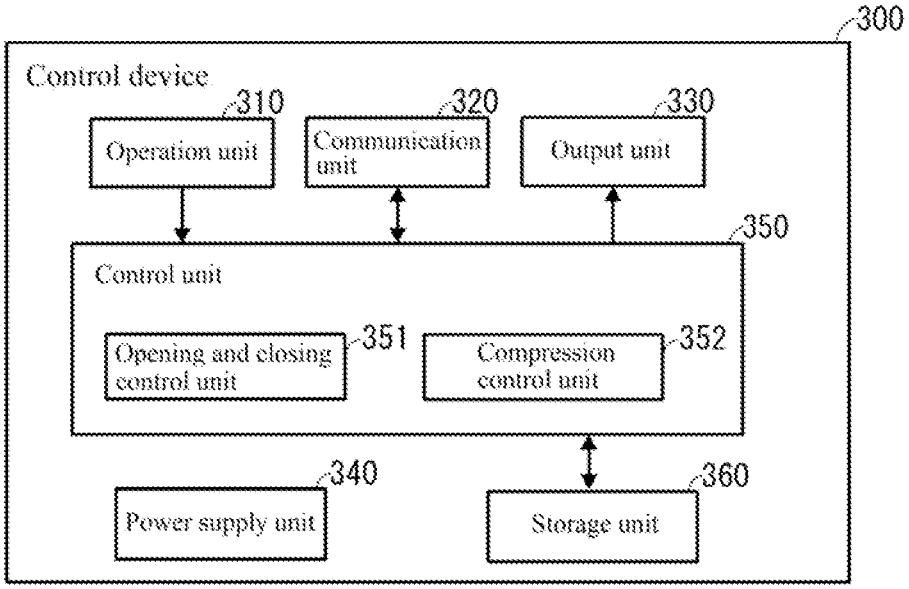
FIG. 3 is a block diagram illustrating an electrical configuration of a control device.

FIG. 3 is a block diagram illustrating an electrical configuration of the control device 300. The control device 300 is a device that controls each unit of the cooling system 1, is provided in the vicinity of the first cooling system 10, and includes, as illustrated in FIG. 3, an operation unit 310, a communication unit 320, an output unit 330, a power supply unit 340, a control unit 350, and a storage unit 360. Additionally, in the embodiment, it will be described that the control device 300 is electrically connected to each of the electrical parts of the first cooling system 10, the second cooling system 100, and the third cooling system 200 (for example, various opening and closing valves, various detection units, and the like) via a wiring (not illustrated).

(Configuration-Control Device-Operation Unit)

The operation unit 310 is an operation section for receiving an operation input for various kinds of information. The operation unit 310 is configured by using a known operation section such as a touch panel, a remote operation section such as a remote controller, or a hard switch.

(Configuration-Control Device-Communication Unit)

The communication unit 320 is a communication section for communicating with each of the electrical parts of the first cooling system 10, the second cooling system 100, and the third cooling system 200 or an external device such as a management server and is configured by using, for example, a known communication section or the like.

(Configuration-Control Device-Output Unit)

The output unit 330 is an output section that outputs various kinds of information on the basis of the control of the control unit 350 and is configured by using, for example, a known display section such as a flat panel display such as a liquid crystal display or an organic EL display or a known audio output section such as a speaker.

(Configuration-Control Device-Power Supply Unit)

The power supply unit 340 is a power supply section that supplies power supplied from a commercial power source (not illustrated) or power stored in the power supply unit 340 to each part of the control device 300.

(Configuration-Control Device-Control Unit)

The control unit 350 is a control section that controls each part of the control device 300. The control unit 350 is, specifically, a computer that includes a CPU, various programs to be interpreted and executed on the CPU (including basic control programs such as OS and application programs started on the OS and realizing specific functions), and an internal memory such as a RAM for storing various programs and various data.

Further, the control unit 350 includes, as illustrated in FIG. 3, an opening and closing control unit 351 and a compression control unit 352 as a functional concept.

The opening and closing control unit 351 is an opening and closing control section that controls the opening and closing of the first opening and closing valve 72*a*, the second opening and closing valve 72*b*, and the third opening and closing valve 72*c* on the basis of the set temperature of the second refrigerant set according to a predetermined method.

The compression control unit 352 is a compression control section that controls the compression unit 20 on the basis of the detection result of the temperature detection unit 73 and the temperature of the second refrigerant acquired by a predetermined method. Additionally, the process executed by the control unit 350 will be described in detail later.

(Configuration-Control Device-Storage Unit)

The storage unit 360 is a recording section that stores a program and various data necessary for the operation of the control device 300 and is configured by using, for example, a hard disk (not illustrated) as an external recording device. However, any other recording medium including a magnetic recording medium such as a magnetic disc, an optical recording medium such as a DVD and Blu-ray disc, or an electrical recording medium such as a Flash Rom, a USB memory, and a SD card can be used instead of the hard disk or together with the hard disk.

With the above-described cooling system 1, it is possible to effectively cool the second refrigerant by using the first refrigerant. Further, it is possible to cool the first refrigerant in the storage part 30 by using the heat (cold heat) of the third sub-pipe 71*c*. Thus, it is possible to store the first refrigerant in the storage part 30 at a high density (specifically, high pressure and high density) and to make the storage part 30 in a compact size while increasing the storage amount of the storage part 30. Further, it is possible to heat the first refrigerant in the storage part 30 by using the heat (warm heat) of the fourth sub-pipe 71*d*. Thus, it is possible to store the first refrigerant in the storage part 30 at a low density (specifically, low pressure and low density) and to store the first refrigerant according to the situation of the storage part 30. Additionally, the "storage part 30", the "first sub-pipe 71*a*", the "second sub-pipe 71*b*", the "third sub-pipe 71*c*", the "fourth sub-pipe 71*d*", the "first opening and closing valve 72*a*", the "second opening and closing valve 72*b*", the "third opening and closing valve 72*c*", the "fourth opening and closing valve 72*d*", and the "opening and closing control unit 351" correspond to the "refrigerant control system" of claims.

(Control Process)

Figure 4:
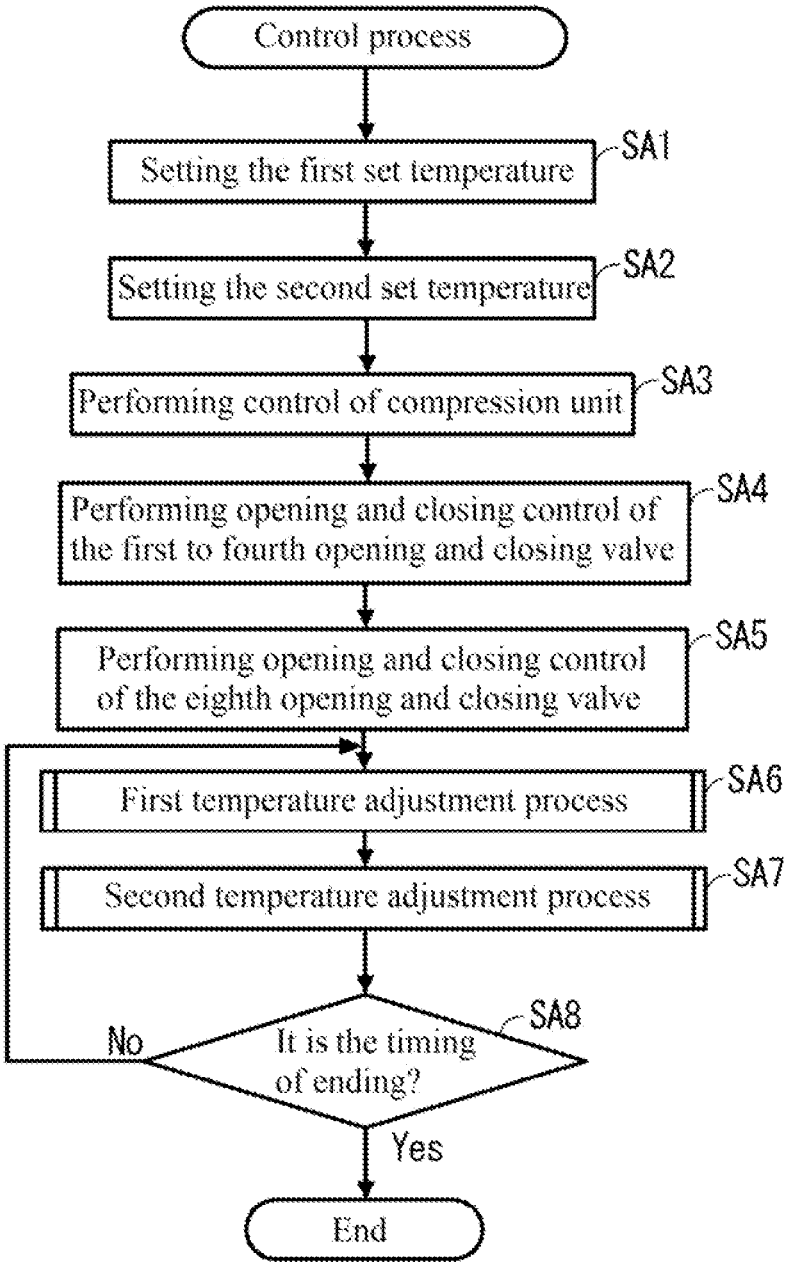
FIG. 4 is a flowchart of a control process according to the embodiment.
Figure 5:
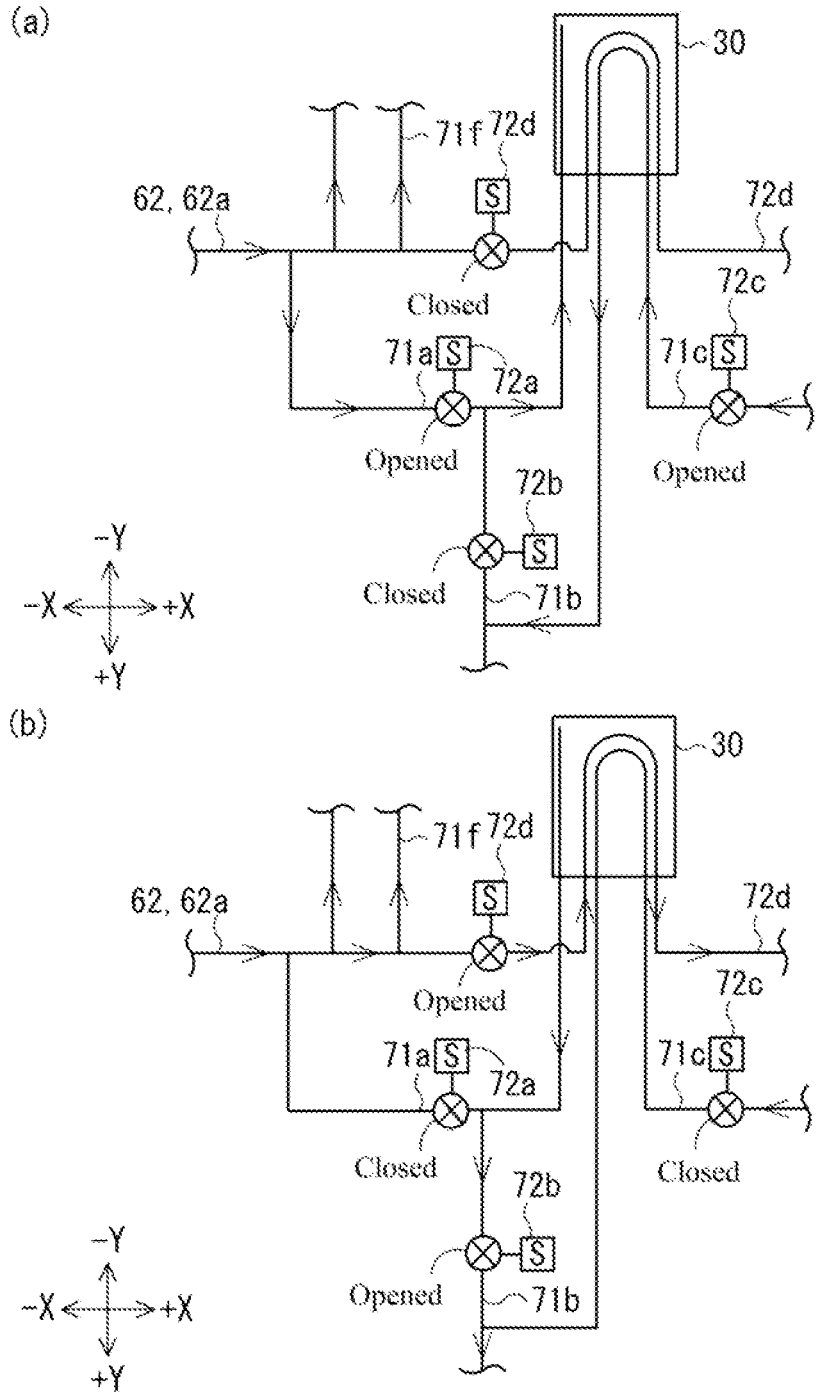
FIG. 5 is a diagram illustrating a flow of a first refrigerant when opening and closing a first opening and closing valve to a fourth opening and closing valve, where FIG. 5(*a*) is a diagram illustrating a state in which the first opening and closing valve and the third opening and closing valve are opened and the second opening and closing valve and the fourth opening and closing valve are closed and FIG. 5(*b*) is a diagram illustrating a state in which the first opening and closing valve and the third opening and closing valve are closed and the second opening and closing valve and the fourth opening and closing valve are opened.

Next, a control process which is executed by the cooling system 1 with the above-described configuration will be described. FIG. 4 is a flowchart of the control process according to the embodiment (in the following description of each process, the step is abbreviated as "S"). FIG. 5 is a diagram illustrating a flow of the first refrigerant when opening and closing the first opening and closing valve 72*a* to the fourth opening and closing valve 72*d*, where FIG. 5(*a*) is a diagram illustrating a state in which the first opening and closing valve 72*a* and the third opening and closing valve 72*c* are opened and the second opening and closing valve 72*b* and the fourth opening and closing valve 72*d* are closed and FIG. 5(*b*) is a diagram illustrating a state in which the first opening and closing valve 72*a* and the third opening and closing valve 72*c* are closed and the second opening and closing valve 72*b* and the fourth opening and closing valve 72*d* are opened.

The control process is a process for controlling the cooling system 1. The timing of executing this control process is arbitrary, but in the embodiment, the timing will be described as being started after the power of the cooling system 1 is turned on.

Further, the premise of the control process is as follows in the embodiment. That is, it is assumed that a desired amount of the first refrigerant is contained in the compression unit 20. Further, it is assumed that the first opening and closing valve 72*a*, the third opening and closing valve 72*c*, the third delivery opening and closing valve 133*c*, the fourth delivery opening and closing valve 133*d*, and the fifth delivery opening and closing valve 133*e* are closed, but the other opening and closing valves are opened in the opening and closing states of various opening and closing valves of the cooling system 1. Accordingly, it is assumed that the first refrigerant can circulate in the first circulation flow path 61 and the second circulation flow path 81, the second refrigerant flows in the delivery flow path 131, and the third refrigerant flows in the first delivery flow path 201 and the second delivery flow path 202.

When the control process is started, as illustrated in FIG. 4, the control unit 350 of the control device 300 sets the set temperature of the first refrigerant (for example, about +70° C. to +90° C., and the like and hereinafter, referred to as a "first set temperature") in SA1. The first set temperature setting method is arbitrary, but in the embodiment, information indicating the set temperature input through the operation unit 310 is set as the first set temperature to be set. However, the invention is not limited thereto, but for example, information indicating the set temperature stored in the storage unit 360 in advance or information indicating the set temperature received from the external device through the communication unit 320 may be set as the first set temperature to be set (additionally, the same applies to a second set temperature setting method of SA2 to be described later).

In SA2, the control unit 350 of the control device 300 sets the set temperature of the second refrigerant (for example, about −20° C. to +80° C., and the like and hereinafter, referred to as a "second set temperature").

In SA3, the compression control unit 352 of the control device 300 controls the compression unit 20 (specifically, control of repeating the operation cycle of the compression unit 20). Additionally, in the embodiment, it is assumed that the process of SA3 is continuously executed until the control process ends.

Here, the control process content of the compression unit 20 is arbitrary, but in the embodiment, the compression unit 20 (specifically, the operation frequency of the compression unit 20) is controlled on the basis of the detection result of the temperature detection unit 73 in the process of SA3 and at least one detection result of the first delivery temperature detection unit 135*a* to the third delivery temperature detection unit 135*c* in the process of SA3.

For example, when the temperature of the second refrigerant acquired from the first delivery temperature detection unit 135*a* (alternatively, the second delivery temperature detection unit 135*b* or the third delivery temperature detection unit 135*c*) is higher than the second set temperature set in SA2, the flow rate of the first refrigerant flowing out from the compression unit 20 is increased by increasing the operation frequency of the compression unit 20 so that the temperature of the first refrigerant acquired from the temperature detection unit 73 decreases.

Further, when the temperature of the second refrigerant acquired from the first delivery temperature detection unit 135*a* (alternatively, the second delivery temperature detection unit 135*b* or the third delivery temperature detection unit 135*c*) is lower than the second set temperature set in SA2, the flow rate of the first refrigerant flowing out from the compression unit 20 is decreased by decreasing the operation frequency of the compression unit 20 so that the temperature of the first refrigerant acquired from the temperature detection unit 73 increases.

With such a process, it is possible to control the compression unit 20 on the basis of the temperature of the first refrigerant and the temperature of the second refrigerant and to efficiently control the compression unit 20.

In SA4, the opening and closing control unit 351 of the control device 300 controls the opening and closing of the first opening and closing valve 72*a*, the second opening and closing valve 72*b*, the third opening and closing valve 72*c*, and the fourth opening and closing valve 72*d* on the basis of the second set temperature set in SA2.

Here, the process content of the opening and closing control of the first opening and closing valve 72*a*, the second opening and closing valve 72*b*, the third opening and closing valve 72*c*, and the fourth opening and closing valve 72*d* is arbitrary, but in the embodiment, these valves are controlled as follows.

That is, when the second set temperature is higher than the critical temperature of the first refrigerant (for example, the critical temperature of the first refrigerant stored in the storage unit 360 in advance), the first opening and closing valve 72*a* and the third opening and closing valve 72*c* are opened and the second opening and closing valve 72*b* and the fourth opening and closing valve 72*d* are closed. Accordingly, as illustrated in FIG. 5(*a*), the first refrigerant in the outlet side pipe 62*a* flows into the storage part 30 and the heat (cold heat) of the third sub-pipe 71*c* is transferred to the first refrigerant in the storage part 30.

Further, when the second set temperature is lower than the critical temperature of the first refrigerant, the first opening and closing valve 72*a* and the third opening and closing valve 72*c* are closed and the second opening and closing valve 72*b* and the fourth opening and closing valve 72*d* are opened. Accordingly, as illustrated in FIG. 5(*b*), the first refrigerant in the storage part 30 flows into the inlet side pipe 62*b* and the heat (warm heat) of the fourth sub-pipe 71*d* is transferred to the first refrigerant in the storage part 30.

In this way, it is possible to effectively cool and heat the first refrigerant in the storage part 30 by the opening and closing control of the first opening and closing valve 72*a*, the second opening and closing valve 72*b*, the third opening and closing valve 72*c*, and the fourth opening and closing valve 72*d* based on the second set temperature and to improve the usability of the cooling system 1 (specifically, the refrigerant control system). Particularly, when the second set temperature is higher than the critical temperature of the first refrigerant, the first refrigerant can flow from the outlet side pipe 62*a* into the storage part 30 and the first refrigerant in the storage part 30 can be cooled by the heat of the third sub-pipe 71*c*. Accordingly, it is possible to increase the density of the first refrigerant in the storage part 30 while suppressing an excessive pressure in the first circulation flow path 61 or an increase in excessive cooling ability when the second set temperature is high. Further, when the second set temperature is lower than the critical temperature of the first refrigerant, the first refrigerant in the storage part 30 can flow into the inlet side pipe 62*b* and the first refrigerant in the storage part 30 can be heated by the heat of the fourth sub-pipe 71*d*. Accordingly, it is possible to decrease the density of the first refrigerant in the storage part 30 while increasing the amount of the refrigerant of the first circulation flow path 61. Further, since the first refrigerant is carbon dioxide, it is possible to prevent the pressure in the first circulation flow path 61 from becoming excessive even if carbon dioxide expands more easily than the chlorofluorocarbon gas. Further, the second refrigerant is a refrigerant for cooling a semiconductor manufacturing system. Accordingly, even when the temperature range of the second refrigerant is relatively wide, it is possible to prevent the pressure of the first circulation flow path 61 from becoming excessive and to prevent the flow rate of the first refrigerant in the first circulation flow path 61 from decreasing due to the condensation of the first refrigerant in the storage part 30.

Returning to FIG. 4, in SA5, the opening and closing control unit 351 of the control device 300 controls the opening and closing of the eighth opening and closing valve 72*h*. Additionally, in the embodiment, the process of SA5 is continued until the control process ends.

Here, the process content of the opening and closing control of the eighth opening and closing valve 72*h* is arbitrary, but in the embodiment, the opening and closing is controlled on the basis of the second set temperature.

For example, when the second set temperature is lower than the threshold value stored in the storage unit 360 in advance, the eighth opening and closing valve 72*h* is opened to a predetermined opening degree. Accordingly, since the first refrigerant in the upstream part in relation to the fifth heat exchange unit 45 in the sixth sub-pipe 71*f* flows into the downstream part in relation to the fifth heat exchange unit 45 in the sixth sub-pipe 71*f*, the heat exchange of the first refrigerant is performed by the fifth heat exchange unit 45.

Further, when the second set temperature is higher than the threshold value, the eighth opening and closing valve 72*h* is closed. Accordingly, since the first refrigerant in the upstream part in relation to the fifth heat exchange unit 45 in the sixth sub-pipe 71*f* does not flow into the downstream part in relation to the fifth heat exchange unit 45 in the sixth sub-pipe 71*f*, the heat exchange of the first refrigerant is not performed by the fifth heat exchange unit 45.

With such a process, it is possible to adjust the opening degree of the eighth opening and closing valve 72*h* on the basis of the second set temperature and to efficiently adjust the temperature of the first refrigerant in the first cooling object side pipe 63*a*.

After the process of SA5, the opening and closing control unit 351 of the control device 300 starts a first temperature adjustment process (SA6).

(Control Process-First Temperature Adjustment Process)

Figure 6:
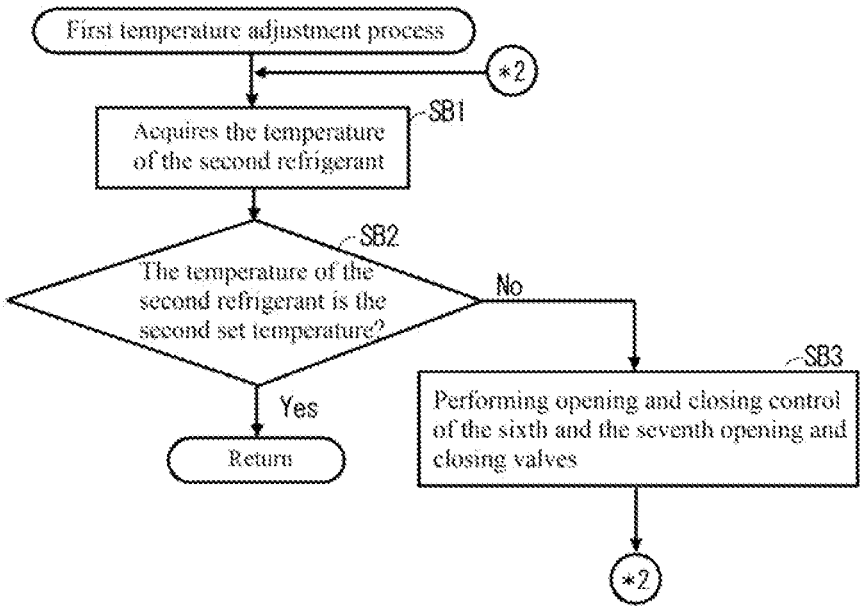
FIG. 6 is a flowchart of a first temperature adjustment process.

Next, the first temperature adjustment process (SA6) of FIG. 4 will be described. FIG. 6 is a flowchart of the first temperature adjustment process. The first temperature adjustment process is a process for adjusting the temperature of the first refrigerant in the cooling object side pipe 63.

When the first temperature adjustment process is started, as illustrated in FIG. 6, in SB1, the opening and closing control unit 351 of the control device 300 acquires the temperature of the second refrigerant from any one of the first delivery temperature detection unit 135*a*, the second delivery temperature detection unit 135*b*, and the third delivery temperature detection unit 135*c*.

In SB2, the opening and closing control unit 351 of the control device 300 determines whether or not the temperature of the second refrigerant acquired in SB1 is the second set temperature. Then, the opening and closing control unit 351 of the control device 300 proceeds to SB3 when the temperature of the second refrigerant is not determined as the second set temperature (SB2, No) and ends the first temperature adjustment process and returns to execute the control process of FIG. 4 when the temperature of the second refrigerant is determined as the second set temperature (SB2, Yes).

In SB3, the opening and closing control unit 351 of the control device 300 performs the opening degree control of the sixth opening and closing valve 72*f* and the seventh opening and closing valve 72*g* on the basis of the temperature of the second refrigerant acquired in SB1. Subsequently, the opening and closing control unit 351 of the control device 300 proceeds to SB1 and repeats the processes from SB1 to SB3 until the temperature of the second refrigerant is determined as the second set temperature in SB2.

Further, the process content of the opening degree control of the sixth opening and closing valve 72*f* and the seventh opening and closing valve 72*g* is arbitrary, but the opening degree may be controlled, for example, as follows.

That is, when the temperature of the second refrigerant acquired in SB1 is higher than the second set temperature set in SA2, the opening degree of the sixth opening and closing valve 72*f* is made wider than the first reference opening degree and the opening degree of the seventh opening and closing valve 72*g* is made narrower than the first reference opening degree. Accordingly, since the amount of the first refrigerant in the first cooling object side pipe 63*a* flowing into the first heat exchange unit 41 increases and the amount of the first refrigerant exchanging heat by the second heat exchange unit 42 and flowing into the inlet side pipe 62*b* decreases, the heating amount of the second heat exchange unit 42 decreases and hence the cooling of the second refrigerant due to the first refrigerant is promoted.

Further, when the temperature of the second refrigerant acquired in SB1 is lower than the second set temperature set in SA2, the opening degree of the sixth opening and closing valve 72*f* is made narrower than the first reference opening degree and the opening degree of the seventh opening and closing valve 72*g* is made wider than the first reference opening degree. Accordingly, since the amount of the first refrigerant in the first cooling object side pipe 63*a* flowing into the first heat exchange unit 41 decreases and the amount of the first refrigerant exchanging heat by the second heat exchange unit 42 and flowing into the inlet side pipe 62*b* increases, the heating amount of the second heat exchange unit 42 increases and hence the cooling of the second refrigerant due to the first refrigerant is suppressed. Additionally, the "first reference opening degree" means, for example, the opening degree of the opening and closing valve when the temperature of the second refrigerant is the same as the second set temperature.

With such a process, it is possible to adjust the opening degree of the sixth opening and closing valve 72*f* and the seventh opening and closing valve 72*g* on the basis of the temperature of the second refrigerant and to efficiently adjust the temperature of the first refrigerant in the cooling object side pipe 63.

Further, it is possible to adjust the temperature of the first refrigerant in the cooling object side pipe 63 so that the temperature of the second refrigerant becomes the second set temperature by such a first temperature adjustment process and thus to efficiently cool the second refrigerant.

Returning to FIG. 4, the opening and closing control unit 351 of the control device 300 starts a second temperature adjustment process (SA7) after the process of SA6.

(Control Process-Second Temperature Adjustment Process)

Figure 7:
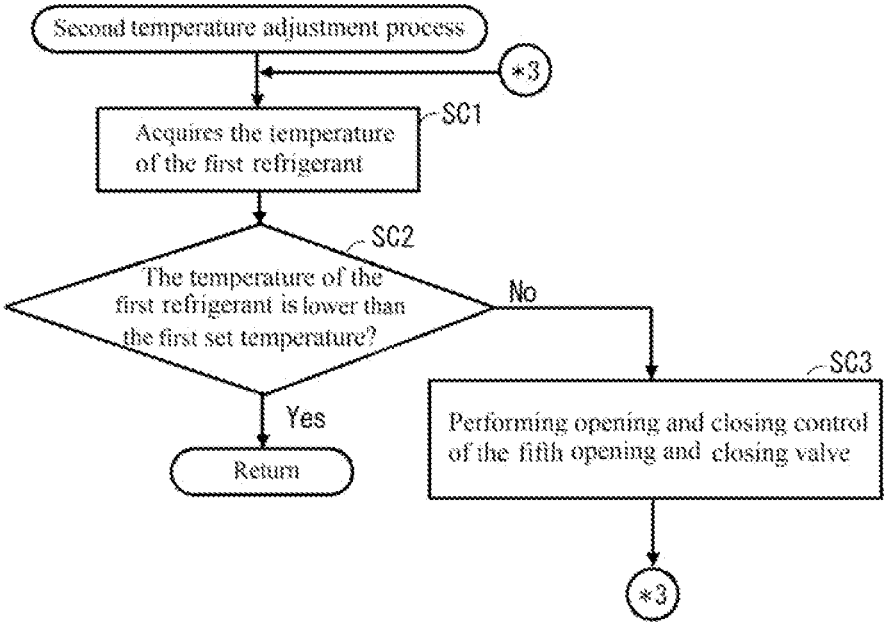
FIG. 7 is a flowchart of a second temperature adjustment process.

Next, the second temperature adjustment process (SA7) of FIG. 4 will be described. FIG. 7 is a flowchart of the second temperature adjustment process. The second temperature adjustment process is a process for adjusting the temperature of the first refrigerant in the outlet side pipe 62*a*.

When the second temperature adjustment process is started, as illustrated in FIG. 7, in SC1, the opening and closing control unit 351 of the control device 300 acquires the temperature of the first refrigerant from the temperature detection unit 73.

In SC2, the opening and closing control unit 351 of the control device 300 determines whether the temperature of the first refrigerant acquired in SC1 is lower than the first set temperature. Then, the opening and closing control unit 351 of the control device 300 proceeds to SC3 when it is not determined that the temperature of the first refrigerant is lower than the first set temperature (SC2, No) and ends the second temperature adjustment process and returns to execute the control process of FIG. 4 when it is determined that the temperature of the first refrigerant is lower than the first set temperature (SC2, Yes).

In SC3, the opening and closing control unit 351 of the control device 300 performs the opening degree control of the fifth opening and closing valve 72*e* on the basis of the temperature of the first refrigerant acquired in SC1. Subsequently, the opening and closing control unit 351 of the control device 300 proceeds to SC1 and repeats the processes from SC1 to SC3 until it is determined that the temperature of the first refrigerant is lower than the first set temperature in SC2.

Further, the process content of the opening degree control of the fifth opening and closing valve 72*e* is arbitrary, but the opening degree may be controlled, for example, as follows.

That is, when the temperature of the first refrigerant acquired in SC1 is higher than the first set temperature set in SA1, the opening degree of the fifth opening and closing valve 72*e* is made wider than the second reference opening degree. Accordingly, since the amount of the first refrigerant in the cooling object side pipe 63 flowing into the inlet side pipe 62*b* increases, the temperature of the first refrigerant in the outlet side pipe 62*a* can be decreased.

Further, when the temperature of the first refrigerant acquired in SC1 matches the first set temperature set in SA1, the opening degree of the fifth opening and closing valve 72*e* is maintained at the second reference opening degree. Accordingly, since the amount of the first refrigerant in the cooling object side pipe 63 flowing into the inlet side pipe 62*b* is maintained, it is possible to suppress an increase in the temperature of the first refrigerant in the outlet side pipe 62*a*. Additionally, the "second reference opening degree" means, for example, the opening degree of the opening and closing valve when the temperature of the first refrigerant is the same as the first set temperature.

With such a process, it is possible to adjust the opening degree of the fifth opening and closing valve 72*e* on the basis of the temperature of the first refrigerant and to efficiently adjust the temperature of the first refrigerant in the outlet side pipe 62*a*.

With the above-described second temperature adjustment process, the temperature of the first refrigerant in the outlet side pipe 62*a* can be adjusted so that the temperature of the first refrigerant becomes the first set temperature. Thus, when the first refrigerant in the outlet side pipe 62*a* flows into the storage part 30 through the first sub-pipe 71*a*, the temperature in the storage part 30 is easily maintained at the critical temperature or more of the first refrigerant due to the heat of the inflowing first refrigerant.

Returning to FIG. 4, in SA8, the control unit 350 of the control device 300 determines whether or not it is the timing of ending the control process (hereinafter, referred to as "end timing"). A method of determining whether or not the end timing has arrived is arbitrary. However, for example, the determination is performed on the basis of whether or not a predetermined operation is received through the operation unit 310. Here, it is determined that the end timing has arrived when the predetermined operation is received and it is determined that the end timing has not arrived when the predetermined operation is not received. Then, when it is determined that the end timing has arrived (SA8, Yes), the control unit 350 of the control device 300 ends the control process. On the other hand, when it is determined that the end timing has not arrived (SA8, No), the routine proceeds to SA6 and proceeds from SA6 to SA8 until it is determined that the end timing has arrived in SA8.

With the above-described control process, it is possible to effectively cool the second refrigerant by using the first refrigerant while maintaining the usability of the cooling system 1.

Effect of Embodiment

According to such an embodiment, since there are provided the first sub-pipe 71*a* which is connected to the outlet side pipe 62*a* constituting the first circulation flow path 61 and located on the outlet side of the compression unit 20 and allows the refrigerant in the outlet side pipe 62*a* to flow into the storage part 30 through the first sub-pipe 71*a*, the second sub-pipe 71*b* which is connected to the inlet side pipe 62*b* constituting the first circulation flow path 61 and located on the inlet side of the compression unit 20 and allows the refrigerant in the storage part 30 to flow into the inlet side pipe 62*b* through the second sub-pipe 71*b*, the third sub-pipe 71*c* which is connected to the inlet side pipe 62*b* and is formed so that the heat of the third sub-pipe 71*c* lower than the heat of the outlet side pipe 62*a* can be transferred to the refrigerant in the storage part 30, the first opening and closing valve 72*a* which is provided in the first sub-pipe 71*a* and is able to switch whether or not to allow the refrigerant in the outlet side pipe 62*a* to flow into the storage part 30, the second opening and closing valve 72*b* which is provided in the second sub-pipe 71*b* and is able to switch whether or not to allow the refrigerant in the storage part 30 to flow into the inlet side pipe 62*b*, and the third opening and closing valve 72*c* which is provided in the third sub-pipe 71*c* and is able to switch whether or not to allow the refrigerant in the upstream part in relation to the storage part 30 in the third sub-pipe 71*c* to flow into a part on the side of the storage part 30 in the third sub-pipe 71*c*, it is possible to cool the refrigerant in the storage part 30 by using the heat (cold heat) of the third sub-pipe 71*c*. Accordingly, it is possible to store the refrigerant in the storage part 30 at a high density and to make the storage part 30 in a compact size while increasing the storage amount of the storage part 30. Further, since the opening and closing control unit 351 is provided to perform the opening and closing control of the first opening and closing valve 72*a*, the second opening and closing valve 72*b*, and the third opening and closing valve 72*c* on the basis of the set temperature of the cooling object, it is possible to perform the opening and closing control of the first opening and closing valve 72*a*, the second opening and closing valve 72*b*, and the third opening and closing valve 72*c* based on the set temperature of the cooling object. Accordingly, it is possible to effectively cool the refrigerant in the storage part 30 and to improve the usability of the refrigerant control system and the cooling system 1.

Further, since the opening and closing control unit 351 opens the first opening and closing valve 72*a* and the third opening and closing valve 72*c* and closes the second opening and closing valve 72*b* when the set temperature of the cooling object is higher than the critical temperature of the refrigerant and closes the first opening and closing valve 72*a* and the third opening and closing valve 72*c* and opens the second opening and closing valve 72*b* when the set temperature of the cooling object is lower than the critical temperature of the refrigerant, it is possible to perform the opening and closing control of the first opening and closing valve 72*a*, the second opening and closing valve 72*b*, and the third opening and closing valve 72*c* depending on whether or not the set temperature of the cooling object is higher than the critical temperature of the refrigerant and to further effectively cool the refrigerant in the storage part 30.

Further, since there are provided the fourth sub-pipe 71*d* which is connected to the outlet side pipe 62*a* and is formed so that the heat of the fourth sub-pipe 71*d* higher than the heat of the third sub-pipe 71*c* can be transferred to the refrigerant in the storage part 30 and the fourth opening and closing valve 72*d* which is provided in the fourth sub-pipe 71*d* and is able to switch whether or not to allow the refrigerant in the upstream part in relation to the storage part 30 in the fourth sub-pipe 71*d* to flow into a part on the side of the storage part 30 in the fourth sub-pipe 71*d*, it is possible to heat the refrigerant in the storage part 30 by using the heat (warm heat) of the fourth sub-pipe 71*d* and to decrease the density of the refrigerant in the storage part 30 while increasing the amount of the refrigerant in the first circulation flow path 61. Further, since the opening and closing control unit 351 performs the opening and closing control of the first opening and closing valve 72*a*, the second opening and closing valve 72*b*, the third opening and closing valve 72*c*, and the fourth opening and closing valve 72*d* on the basis of the set temperature of the cooling object, it is possible to perform the opening and closing control of the first opening and closing valve 72*a*, the second opening and closing valve 72*b*, the third opening and closing valve 72*c*, and the fourth opening and closing valve 72*d* on the basis of the set temperature of the cooling object. Accordingly, it is possible to effectively cool and heat the refrigerant in the storage part 30 and to store the refrigerant depending on the situation in the storage part 30.

Further, since the opening and closing control unit 351 opens the first opening and closing valve 72*a* and the third opening and closing valve 72*c* and closes the second opening and closing valve 72*b* and the fourth opening and closing valve 72*d* when the set temperature of the cooling object is higher than the critical temperature of the refrigerant and closes the first opening and closing valve 72*a* and the third opening and closing valve 72*c* and opens the second opening and closing valve 72*b* and the fourth opening and closing valve 72*d* when the set temperature of the cooling object is lower than the critical temperature of the refrigerant, it is possible to perform the opening and closing control of the first opening and closing valve 72*a*, the second opening and closing valve 72*b*, the third opening and closing valve 72*c*, and the fourth opening and closing valve 72*d* depending on whether or not the set temperature of the cooling object is higher than the critical temperature of the refrigerant and to further effectively cool and heat the refrigerant in the storage part 30.

Further, since it is possible to prevent the refrigerant in the storage part 30 from reversely flowing to the outlet side pipe 62*a* or the inlet side pipe 62*b* through the first sub-pipe 71*a* or the second sub-pipe 71*b* by forming the first sub-pipe 71*a* and the second sub-pipe 71*b* so that a part of each of the first sub-pipe 71*a* and the second sub-pipe 71*b* is located above the other part, the density of the refrigerant in the storage part 30 becomes much larger than the density of the refrigerant in the first sub-pipe 71*a* and the second sub-pipe 71*b* when cooling the storage part 30. Accordingly, it is possible to prevent the refrigerant in the storage part 30 from reversely flowing to the outlet side pipe 62*a* or the inlet side pipe 62*b* through the first sub-pipe 71*a* or the second sub-pipe 71*b* due to gravity and to accurately manage the amount of the refrigerant in the first circulation flow path 61.

Further, since the inflow preventing portion 76 is provided to prevent foreign matter from flowing into the storage part 30 through the first sub-pipe 71*a*, it is possible to prevent foreign matter from flowing into the storage part 30 through the first sub-pipe 71*a* and to prevent the refrigerant in the storage part 30 from being contaminated by foreign matter.

Further, since the refrigerant is carbon dioxide, it is possible to prevent the pressure in the first circulation flow path 61 from becoming excessive even if carbon dioxide expands more easily than the chlorofluorocarbon gas.

Further, the cooling object is the refrigerant for cooling the semiconductor manufacturing system. Accordingly, even when the temperature range of the cooling object is relatively wide, it is possible to prevent the pressure of the first circulation flow path 61 from becoming excessive and to prevent the flow rate of the refrigerant in the first circulation flow path 61 from decreasing due to the condensation of the refrigerant in the storage part 30.

Further, since the cooling object side pipe 63 includes the first cooling object side pipe 63*a* which is located on the side of the first heat exchange unit 41 and the second cooling object side pipe 63*b* which is located on the side of the second heat exchange unit 42, the detection section is provided to detect the temperature in the outlet side pipe 62*a* or the temperature in the inlet side pipe 62*b*, the fifth sub-pipe 71*e* is provided to be connected to the upstream part in relation to the first heat exchange unit 41 in the first cooling object side pipe 63*a* and the inlet side pipe 62*b*, the fifth opening and closing valve 72*e* is provided in the fifth sub-pipe 71*e* to adjust the amount of the refrigerant in the cooling object side pipe 63 flowing into the inlet side pipe 62*b*, and the opening and closing control unit 351 performs the opening degree control of the fifth opening and closing valve 72*e* on the basis of the detection result of the detection section, it is possible to adjust the opening degree of the fifth opening and closing valve 72*e* on the basis of the temperature of the refrigerant and to efficiently adjust the temperature of the refrigerant in the outlet side pipe 62*a*.

Further, since there are provided the sixth opening and closing valve 72*f* which is provided in the upstream part in relation to the first heat exchange unit 41 in the first cooling object side pipe 63*a* and is able to adjust the amount of the refrigerant in the first cooling object side pipe 63*a* flowing into the first heat exchange unit 41 and the seventh opening and closing valve 72*g* which is provided in the downstream part in relation to the second heat exchange unit 42 in the second cooling object side pipe 63*b* and is able to adjust the amount of the refrigerant exchanging heat by the second heat exchange unit 42 and flowing into the inlet side pipe 62*b* and the opening and closing control unit 351 performs the opening degree control of the sixth opening and closing valve 72*f* and the seventh opening and closing valve 72*g* on the basis of the temperature of the cooling object acquired by a predetermined method, it is possible to adjust the opening degree of the sixth opening and closing valve 72*f* and the seventh opening and closing valve 72*g* on the basis of the temperature of the cooling object and to efficiently adjust the temperature of the refrigerant in the cooling object side pipe 63.

Further, since the compression control unit 352 is provided to control the compression unit 20 on the basis of the detection result of the detection section and the temperature of the cooling object acquired by a predetermined method, it is possible to control the compression unit 20 on the basis of the temperature of the refrigerant and the temperature of the cooling object and to efficiently control the compression unit 20.

Further, since there is provided the sixth heat exchange unit 46 which exchanges heat between the refrigerant in the upstream part in relation to the first heat exchange unit 41 in the first cooling object side pipe 63*a* and the refrigerant in the downstream part in relation to the second heat exchange unit 42 in the second cooling object side pipe 63*b*, it is possible to increase the temperature of the refrigerant in the downstream part in relation to the second heat exchange unit 42 in the second cooling object side pipe 63*b* and to allow the dry refrigerant to flow into the compression unit 20.

[III] Modified Example of Embodiment

Although the embodiment of the invention has been described above, the specific configuration and section of the invention can be arbitrarily modified and improved within the scope of the technical idea of each invention described in the claims. Hereinafter, such modified examples will be described.

Problem to be Solved and Effect of Invention

First, the problem to be solved by the invention and the effect of the invention are not limited to the above-described contents and the invention solves a problem not described above or achieves an effect not described above. In addition, the invention solves only some of the problems described above or achieves only some of the effects described above.

(Distribution and Integration)

Further, each of the above-described electrical components is a functional concept and does not necessarily have to be physically configured as illustrated in the drawings. That is, the specific form of distribution or integration of each part is not limited to the one illustrated in the drawings and all or part of the parts may be functionally or physically distributed or integrated in arbitrary units according to various loads, usage conditions, and the like. Further, the "system" in the present application is not limited to a system configured as a plurality of devices, but includes a system configured as a single device. Further, the "device" in the present application is not limited to a device configured as a single device, but includes a device configured as a plurality of devices. Further, the data structure of each of information described in the above-described embodiment may be arbitrarily changed. For example, the control device 300 may be distributed to a plurality of devices capable of communicating with each other, the control unit 350 may be provided in a part of the plurality of devices, and the storage unit 360 may be provided in the other part of the plurality of devices.

(Shape, Numerical Value, Structure, and Time Series)

In the components illustrated in the embodiment or drawings, the shape, numerical value, structure, or time-series relationship of a plurality of components can be arbitrarily modified and improved within the scope of the technical idea of the invention.

(Third Refrigerant)

In the above-described embodiment, a case has been described in which the third refrigerant is industrial water, but the invention is not limited thereto. For example, the third refrigerant may be air. In this case, the third cooling system 200 may include a first delivery unit (for example, a known blower) which sends the third refrigerant to the third heat exchange unit 43 and a second delivery unit (for example, a known blower) which sends the third refrigerant to the fourth heat exchange unit 44.

(First Cooling System)

In the above-described embodiment, a case has been described in which the first cooling system 10 includes the fifth heat exchange unit 45, the sixth heat exchange unit 46, the first removing unit 47, and the second removing unit 48, but the invention is not limited thereto. For example, at least one of the fifth heat exchange unit 45, the sixth heat exchange unit 46, the first removing unit 47, and the second removing unit 48 may be omitted. Additionally, when the fifth heat exchange unit 45 is omitted, the eighth opening and closing valve 72*h* can be omitted.

Further, in the above-described embodiment, a case has been described in which the first cooling system 10 includes the fifth opening and closing valve 72*e*, the sixth opening and closing valve 72*f*, the seventh opening and closing valve 72*g*, and the eighth opening and closing valve 72*h*, but the invention is not limited thereto. For example, at least one of the fifth opening and closing valve 72*e*, the sixth opening and closing valve 72*f*, the seventh opening and closing valve 72*g*, and the eighth opening and closing valve 72*h* may be omitted. Additionally, when the fifth opening and closing valve 72*e* is omitted, the process of SA7 of the control process can be omitted. Further, when the sixth opening and closing valve 72*f* and the seventh opening and closing valve 72*g* are omitted, the process of SA6 of the control process can be omitted. Further, when the eighth opening and closing valve 72*h* is omitted, the process of SA5 of the control process can be omitted.

Further, in the above-described embodiment, a case has been described in which the first cooling system 10 includes the compression unit 20, the storage part 30, the first heat exchange unit 41 to the sixth heat exchange unit 46, the first removing unit 47, the second removing unit 48, and the circulation unit 50, but the invention is not limited thereto. For example, a temperature adjustment unit may be provided in addition to these components. Here, the temperature adjustment unit is a temperature adjustment section that adjusts the temperature of the first refrigerant in the storage part 30, is configured by using, for example, a known temperature adjuster (for example, a temperature adjuster having at least a heating function or a cooling function) or the like, and is provided in the storage part 30. Further, the method of installing the temperature adjustment unit is arbitrary, but for example, the temperature adjustment unit may be installed in the storage part 30 or may be installed to be wound on the storage part 30 outside the storage part 30. Such a temperature adjustment unit can adjust the temperature of the first refrigerant in the storage part 30 and can cool the refrigerant in the storage part 30 by using, for example, the heat (cold heat) of the temperature adjustment unit. Accordingly, the refrigerant is easily stored at a high density in the storage part 30.

Figure 8:
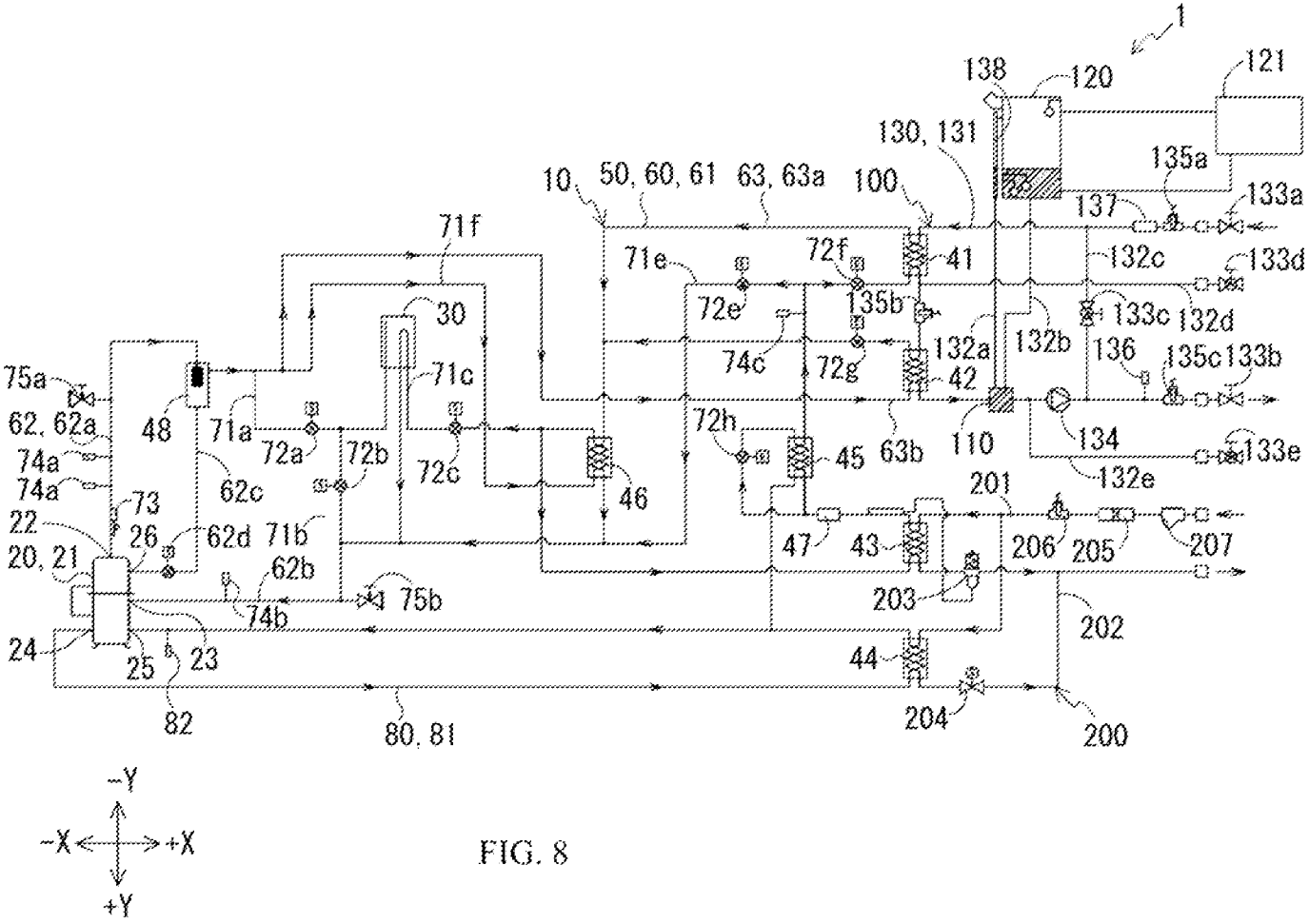
FIG. 8 is a diagram illustrating a modified example of the cooling system.

Further, in the above-described embodiment, a case has been described in which the first cooling system 10 includes the fourth sub-pipe 71*d* and the fourth opening and closing valve 72*d*, but the invention is not limited thereto. FIG. 8 is a diagram illustrating a modified example of the cooling system 1. For example, as illustrated in FIG. 8, the fourth sub-pipe 71*d* and the fourth opening and closing valve 72*d* may be omitted. In this case, in SA4 of the control process, the opening and closing control of the first opening and closing valve 72*a*, the second opening and closing valve 72*b*, and the third opening and closing valve 72*c* is performed on the basis of the second set temperature set in SA2. Specifically, the first opening and closing valve 72*a* and the third opening and closing valve 72*c* may be opened and the second opening and closing valve 72*b* may be closed when the second set temperature is higher than the critical temperature of the first refrigerant and the first opening and closing valve 72*a* may be closed and the second opening and closing valve 72*b* may be opened when the second set temperature is lower than the critical temperature of the first refrigerant. Accordingly, it is possible to perform the opening and closing control of the first opening and closing valve 72*a*, the second opening and closing valve 72*b*, and the third opening and closing valve 72*c* depending on whether or not the second set temperature is higher than the critical temperature of the first refrigerant and to effectively cool the first refrigerant in the storage part 30.

(Circulation Unit)

Figure 9:
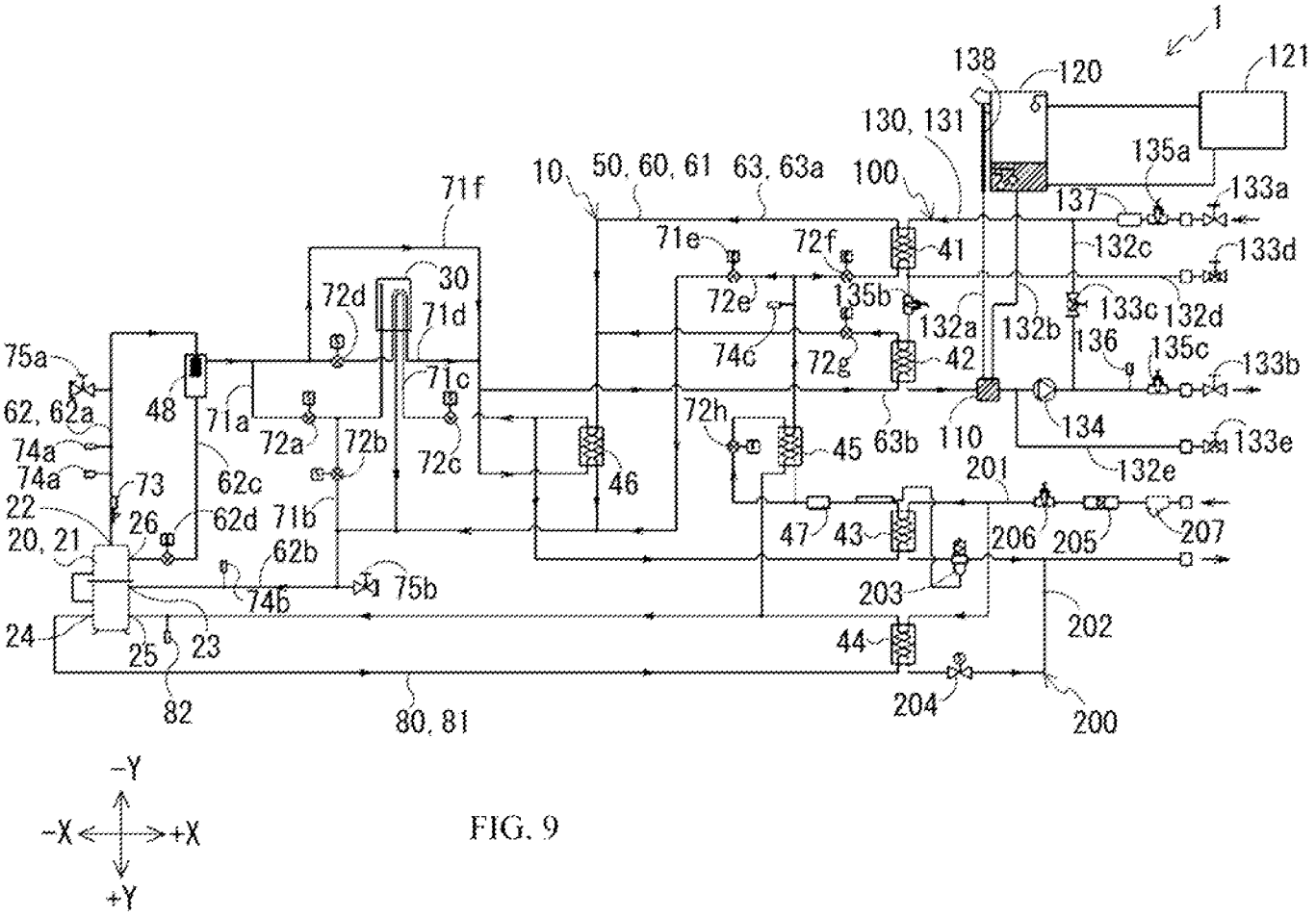
FIG. 9 is a diagram illustrating a modified example of the cooling system.

In the above-described embodiment, a case has been described in which the outlet side pipe 62*a* of the circulation unit 50 and the sixth sub-pipe 71*f* are respectively formed as separate members, but the invention is not limited thereto. FIG. 9 is a diagram illustrating a modified example of the cooling system 1. For example, from the viewpoint of decreasing the number of the pipes, as illustrated in FIG. 9, the outlet side pipe 62*a* and the sixth sub-pipe 71*f* may be integrally formed with each other.

Figure 10:
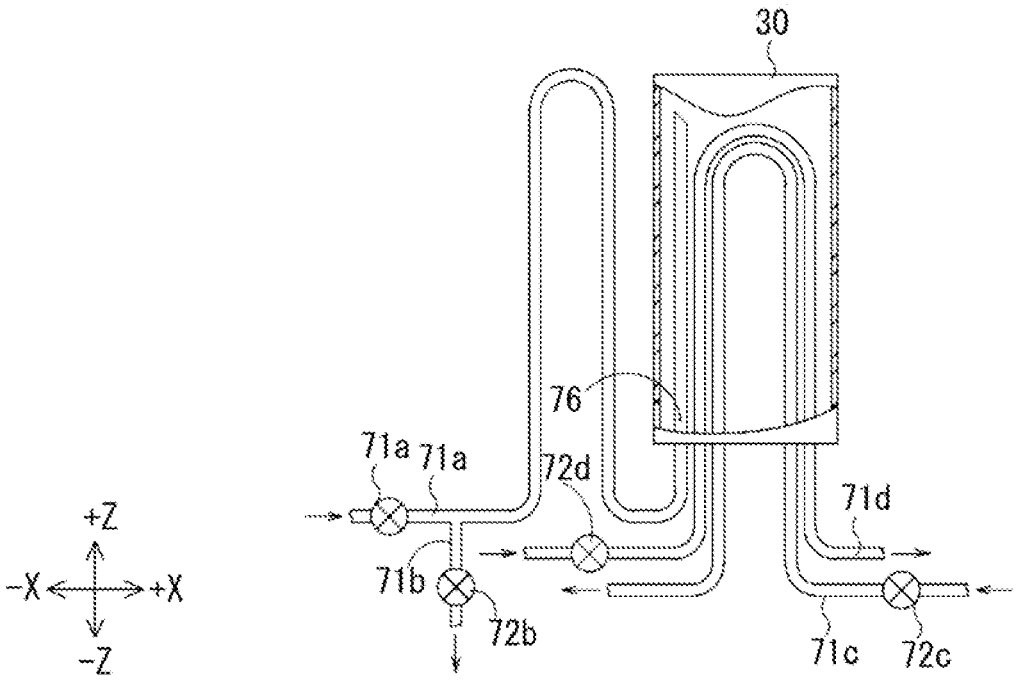
FIG. 10 is a diagram illustrating a modified example of a first sub-pipe and a second sub-pipe.

Further, in the above-described embodiment, a case has been described in which the first sub-pipe 71*a* and the second sub-pipe 71*b* are bent so that a front end portion of a part accommodated in the storage part 30 in each of the first sub-pipe 71*a* and the second sub-pipe 71*b* is located in the vicinity of the upper end of the storage part 30 and is located above the third sub-pipe 71*c* and the fourth sub-pipe 71*d*, but the invention is not limited thereto. FIG. 10 is a diagram illustrating a modified example of the first sub-pipe 71*a* and the second sub-pipe 71*b*. For example, as illustrated in FIG. 10, the first sub-pipe 71*a* and the second sub-pipe 71*b* may be bent so that a part not accommodated in the storage part 30 in each of the first sub-pipe 71*a* and the second sub-pipe 71*b* is located above the third sub-pipe 71*c* and the fourth sub-pipe 71*d* in addition to the bending of the first sub-pipe 71*a* and the second sub-pipe 71*b*.

Further, in the above-described embodiment, a case has been described in which the inflow preventing portion 76 is provided in the first sub-pipe 71*a* of the circulation unit 50, but the invention is not limited thereto. For example, the inflow preventing portion 76 may be omitted.

(Storage Part)

Figure 11:
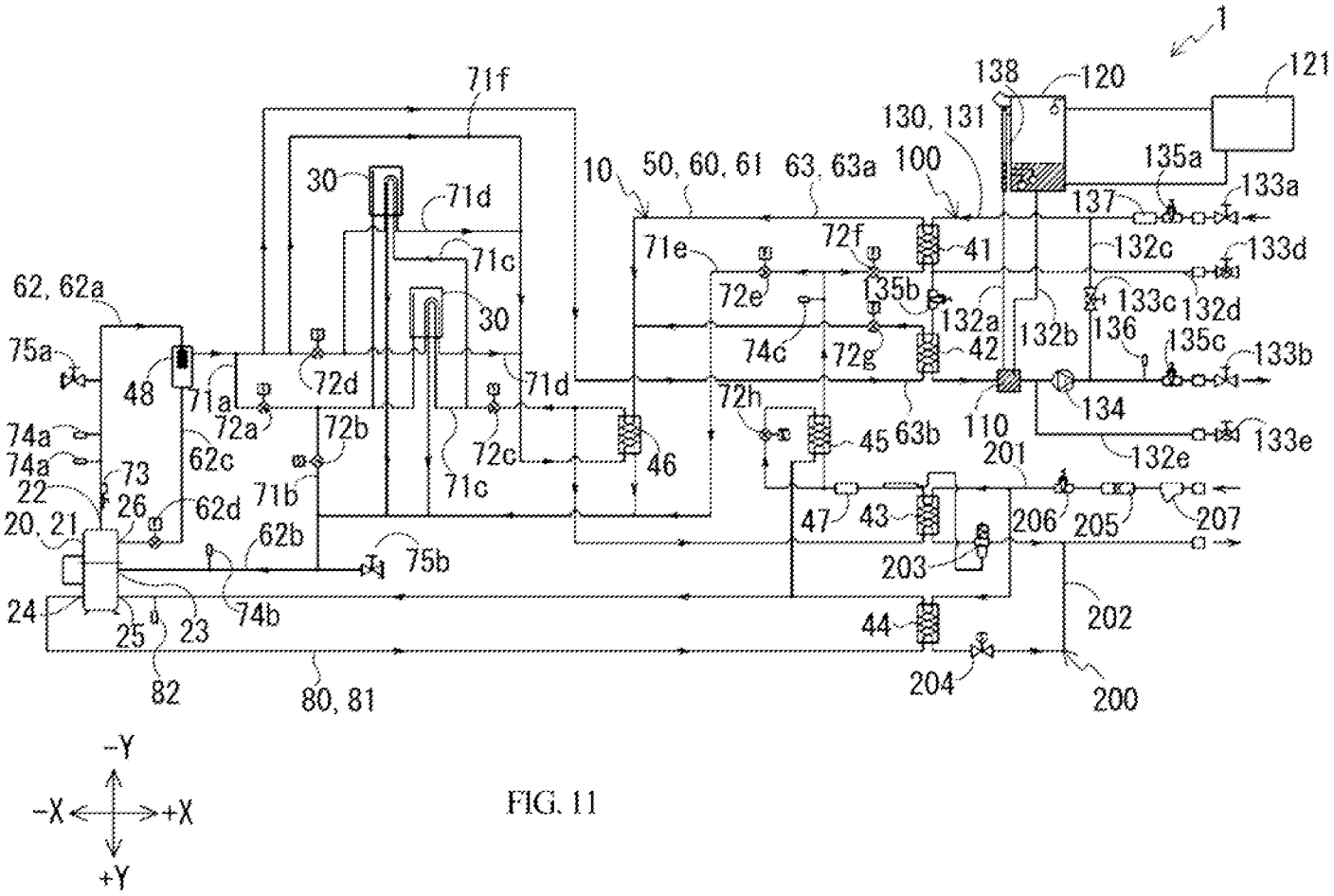
FIG. 11 is a diagram illustrating a modified example of the cooling system.
Figure 12:
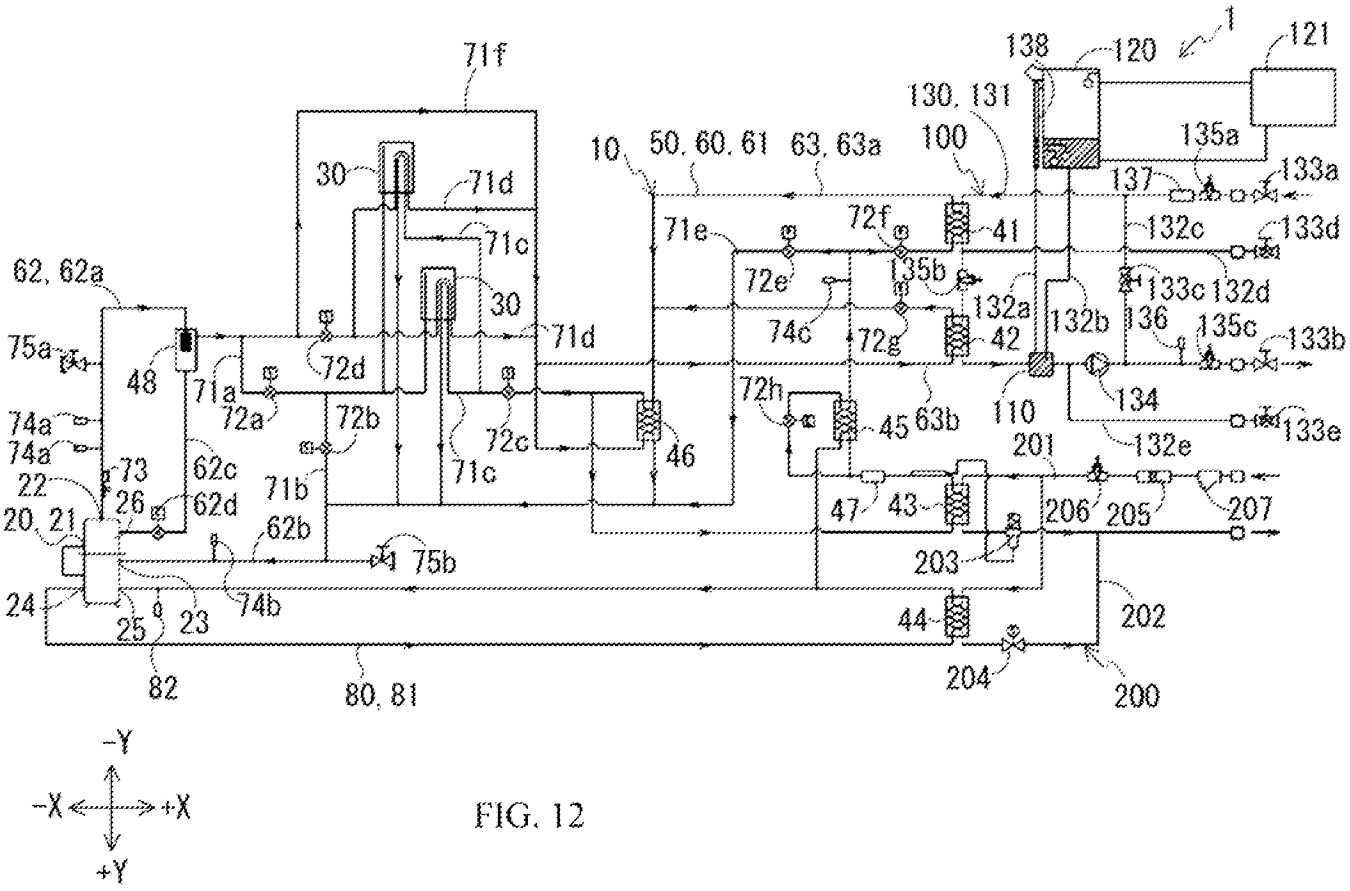
FIG. 12 is a diagram illustrating a modified example of the cooling system.
Figure 13:
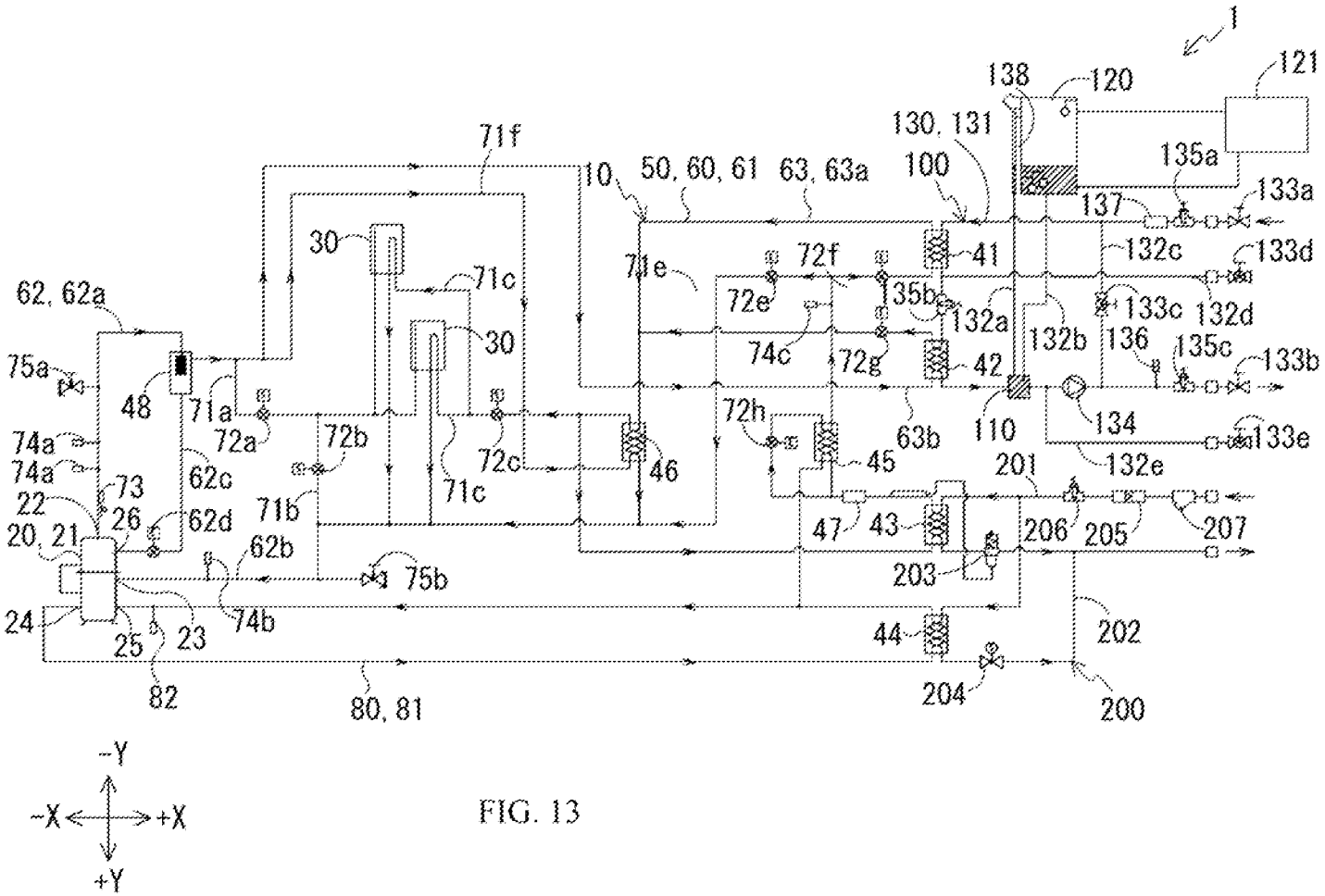
FIG. 13 is a diagram illustrating a modified example of the cooling system.

In the above-described embodiment, a case has been described in which the number of the installed storage parts 30 is one, but the invention is not limited thereto. FIGS. 11 to 13 are diagrams illustrating a modified example of the cooling system 1. For example, as illustrated in FIG. 11, the number of the installed storage parts 30 may be two or more. In this case, each of the first sub-pipe 71*a* and the second sub-pipe 71*b* may be branched and the branched part may be provided in each storage part 30 so that the first refrigerant in each storage part 30 flows therethrough. Further, each storage part 30 may be provided with each of the third sub-pipe 71*c* and the fourth sub-pipe 71*d* so that the first refrigerant in each storage part 30 can be cooled by using the heat (cold heat) of the third sub-pipe 71*c* and the first refrigerant in the storage part 30 can be heated by using the heat (warm heat) of the fourth sub-pipe 71*d*.

Additionally, in FIG. 11, the outlet side pipe 62*a* and the sixth sub-pipe 71*f* are formed separately from each other, but the invention is not limited thereto. For example, as illustrated in FIG. 12, the outlet side pipe 62*a* and the sixth sub-pipe 71*f* may be integrally formed with each other. Further, in FIG. 11, the fourth sub-pipe 71*d* and the fourth opening and closing valve 72*d* are provided, but the invention is not limited thereto. For example, as illustrated in FIG. 13, the fourth sub-pipe 71*d* and the fourth opening and closing valve 72*d* may be omitted. Further, in FIG. 11, the first refrigerant in the outlet side pipe 62*a* selectively flows into the plurality of storage parts 30 by using one first opening and closing valve 72*a*, but the invention is not limited thereto. For example, the first opening and closing valve 72*a* corresponding to each storage part 30 may be provided and the first refrigerant in the outlet side pipe 62*a* may individually and selectively flow into each storage part 30 by using the first opening and closing valve 72*a* (additionally, the same applies to the second opening and closing valve 72*b*, the third opening and closing valve 72*c*, and the fourth opening and closing valve 72*d*).

(Compression Unit)

In the above-described embodiment, a case has been described in which the compression unit 20 is a frequency-controlled operation type compressor, but the invention is not limited thereto. For example, the compression unit may be a constant speed operation type compressor.

Further, in the above-described embodiment, a case has been described in which the compression unit 20 is a two-stage compressor, but the invention is not limited thereto. For example, the compression unit 20 may be a one-stage compressor. In this case, the cooling system 1 can omit the fourth heat exchange unit 44, the second circulation unit 80, the second delivery flow path 202, and the second delivery opening and closing valve 204.

(Second Cooling System)

In the above-described embodiment, a case has been described in which the second cooling system 100 includes the air vent unit 110, the storage part 120, the first sub-delivery pipe 132*a* to the fourth sub-delivery pipe 132*d*, the first delivery opening and closing valve 133*a* to the fourth delivery opening and closing valve 133*d*, the pump unit 134, the first delivery temperature detection unit 135*a*, the second delivery temperature detection unit 135*b*, the delivery pressure detection unit 136, and the flow rate detection unit 137, but the invention is not limited thereto. For example, at least one of the air vent unit 110, the storage part 120, the first sub-delivery pipe 132*a* to the fourth sub-delivery pipe 132*d*, the first delivery opening and closing valve 133*a* to the fourth delivery opening and closing valve 133*d*, the pump unit 134, the first delivery temperature detection unit 135*a*, the second delivery temperature detection unit 135*b*, the delivery pressure detection unit 136, and the flow rate detection unit 137 may be omitted.

(Third Cooling System)

In the above-described embodiment, a case has been described in which the third cooling system 200 includes the sixth delivery opening and closing valve 203 to the eighth delivery opening and closing valve 205 and the delivery temperature detection unit 206, but the invention is not limited thereto. For example, at least one of the sixth delivery opening and closing valve 203 to the eighth delivery opening and closing valve 205 and the delivery temperature detection unit 206 may be omitted.

(Control Process)

In the above-described embodiment, a case has been described in which the operation frequency of the compression unit 20 is controlled on the basis of the detection result of the temperature detection unit 73 and at least one detection result of the first delivery temperature detection unit 135*a* to the third delivery temperature detection unit 135*c* in SA3, but the invention is not limited thereto. For example, the operation frequency of the compression unit 20 may be controlled at a constant frequency.

Further, in the above-described embodiment, a case has been described in which the process of SA4 is performed so that the first opening and closing valve 72*a* and the third opening and closing valve 72*c* are opened and the second opening and closing valve 72*b* and the fourth opening and closing valve 72*d* are closed when the second set temperature is higher than the critical temperature of the first refrigerant and the first opening and closing valve 72*a* and the third opening and closing valve 72*c* are closed and the second opening and closing valve 72*b* and the fourth opening and closing valve 72*d* are opened when the second set temperature is lower than the critical temperature of the first refrigerant, but the invention is not limited thereto. For example, the control may be as follows.

That is, when the second set temperature is higher than the critical temperature of the first refrigerant, the first opening and closing valve 72*a* and the third opening and closing valve 72*c* may be opened and the second opening and closing valve 72*b* and the fourth opening and closing valve 72*d* may be closed until the pressure state in the storage part 30 reaches a predetermined high pressure state. Then, when the pressure state reaches the predetermined high pressure state, the first opening and closing valve 72*a* may be closed while the third opening and closing valve 72*c* is opened and the second opening and closing valve 72*b* and the fourth opening and closing valve 72*d* are closed. Further, when the second set temperature is lower than the critical temperature of the first refrigerant, the first opening and closing valve 72*a* and the third opening and closing valve 72*c* may be closed and the second opening and closing valve 72*b* and the fourth opening and closing valve 72*d* may be opened until the pressure state in the storage part 30 reaches a predetermined low pressure state. Then, when the pressure state reaches the predetermined low pressure state, the second opening and closing valve 72*b* may be closed while the first opening and closing valve 72*a* and the third opening and closing valve 72*c* are closed and the fourth opening and closing valve 72*d* is opened.

Alternatively, at least when an operating pressure value of the compression unit 20 acquired by a predetermined method (for example, a pressure value or the like acquired from the first pressure detection unit 74*a*) is higher than the threshold value or the second set temperature is higher than the critical temperature of the first refrigerant, the first opening and closing valve 72*a* and the third opening and closing valve 72*c* may be opened and the second opening and closing valve 72*b* and the fourth opening and closing valve 72*d* may be closed. On the other hand, at least when the operating pressure value of the compression unit 20 is lower than the threshold value or the second set temperature is lower than the critical temperature of the first refrigerant, the first opening and closing valve 72*a* and the third opening and closing valve 72*c* may be closed and the second opening and closing valve 72*b* and the fourth opening and closing valve 72*d* may be opened. In this way, it is possible to perform the opening and closing control of the first opening and closing valve 72*a*, the second opening and closing valve 72*b*, the third opening and closing valve 72*c*, and the fourth opening and closing valve 72*d* on the basis of at least one of the operating pressure value of the compression unit 20 and the second set temperature and it is easy to maintain the temperature in the storage part 30 at the critical temperature or more of the first refrigerant (or a superheated steam temperature) due to the heat of the first refrigerant flowing into the storage part 30 while suppressing an excessive pressure in the first circulation flow path 61 compared to a case in which the opening and closing control of the first opening and closing valve 72*a*, the second opening and closing valve 72*b*, the third opening and closing valve 72*c*, and the fourth opening and closing valve 72*d* is performed only on the basis of the second set temperature (additionally, the cooling system 1 in which the fourth sub-pipe 71*d* and the fourth opening and closing valve 72*d* are omitted may be treated in a substantially same manner).

One embodiment of the present invention provides a refrigerant control system for controlling a refrigerant flowing in a circulation flow path connected to a compression section and circulating the refrigerant compressed by the compression section so as to exchange heat between the refrigerant and a cooling object, the refrigerant control system comprises: a storage section which stores the refrigerant; a first pipe which is connected to an outlet side pipe constituting the circulation flow path and located on an outlet side of the compression section and allows the refrigerant in the outlet side pipe to flow into the storage section through the first pipe; a second pipe which is connected to an inlet side pipe constituting the circulation flow path and located on an inlet side of the compression section and allows the refrigerant in the storage section to flow into the inlet side pipe through the second pipe; a third pipe which is connected to the inlet side pipe and is formed so that heat of the third pipe lower than heat of the outlet side pipe is able to be transferred to the refrigerant in the storage section; a first opening and closing valve which is provided in the first pipe and switches whether or not to allow the refrigerant in the outlet side pipe to flow into the storage section; a second opening and closing valve which is provided in the second pipe and switches whether or not to allow the refrigerant in the storage section to flow into the inlet side pipe; a third opening and closing valve which is provided in the third pipe and switches whether or not to allow the refrigerant in an upstream part in relation to the storage section in the third pipe to flow into a part on the side of the storage section in the third pipe; and an opening and closing control section which performs opening and closing control of the first opening and closing valve, the second opening and closing valve, and the third opening and closing valve on the basis of a set temperature of the cooling object.

According to this embodiment, since there are provided a first pipe which is connected to an outlet side pipe constituting the circulation flow path and located on an outlet side of the compression section and allows the refrigerant in the outlet side pipe to flow into the storage section through the first pipe; a second pipe which is connected to an inlet side pipe constituting the circulation flow path and located on an inlet side of the compression section and allows the refrigerant in the storage section to flow into the inlet side pipe through the second pipe; a third pipe which is connected to the inlet side pipe and is formed so that heat of the third pipe lower than heat of the outlet side pipe is able to be transferred to the refrigerant in the storage section; a first opening and closing valve which is provided in the first pipe and switches whether or not to allow the refrigerant in the outlet side pipe to flow into the storage section; a second opening and closing valve which is provided in the second pipe and switches whether or not to allow the refrigerant in the storage section to flow into the inlet side pipe; a third opening and closing valve which is provided in the third pipe and switches whether or not to allow the refrigerant in an upstream part in relation to the storage section in the third pipe to flow into a part on the side of the storage section in the third pipe, it is possible to cool the refrigerant in the storage section by using the heat (cold heat) of the third pipe. Accordingly, it is possible to store the refrigerant in the storage section at a high density and to make the storage section in a compact size while increasing the storage amount of the storage section. Further, since the opening and closing control unit is provided to perform the opening and closing control of the first opening and closing valve, the second opening and closing valve, and the third opening and closing valve on the basis of the set temperature of the cooling object, it is possible to perform the opening and closing control of the first opening and closing valve, the second opening and closing valve, and the third opening and closing valve based on the set temperature of the cooling object. Accordingly, it is possible to effectively cool the refrigerant in the storage section and to improve the usability of the refrigerant control system and the cooling system.

Another embodiment of the present invention provides the refrigerant control system according to the above embodiment, wherein the opening and closing control section opens the first opening and closing valve and the third opening and closing valve and closes the second opening and closing valve when the set temperature of the cooling object is higher than a critical temperature of the refrigerant and closes the first opening and closing valve and the third opening and closing valve and opens the second opening and closing valve when the set temperature of the cooling object is lower than the critical temperature of the refrigerant.

According to this embodiment, since the opening and closing control section opens the first opening and closing valve and the third opening and closing valve and closes the second opening and closing valve when the set temperature of the cooling object is higher than a critical temperature of the refrigerant and closes the first opening and closing valve and the third opening and closing valve and opens the second opening and closing valve when the set temperature of the cooling object is lower than the critical temperature of the refrigerant, it is possible to perform the opening and closing control of the first opening and closing valve, the second opening and closing valve, and the third opening and closing valve depending on whether or not the set temperature of the cooling object is higher than the critical temperature of the refrigerant and to further effectively cool the refrigerant in the storage section.

Another embodiment of the present invention provides the refrigerant control system according to the above embodiment, wherein the opening and closing control section opens the first opening and closing valve and the third opening and closing valve and closes the second opening and closing valve at least when an operating pressure value of the compression section acquired by a predetermined method is higher than a threshold value or the set temperature of the cooling object is higher than the critical temperature of the refrigerant and closes the first opening and closing valve and the third opening and closing valve and opens the second opening and closing valve at least when the operating pressure value of the compression section is lower than the threshold value or the set temperature of the cooling object is lower than the critical temperature of the refrigerant.

According to this embodiment, since the opening and closing control section opens the first opening and closing valve and the third opening and closing valve and closes the second opening and closing valve at least when an operating pressure value of the compression section acquired by a predetermined method is higher than a threshold value or the set temperature of the cooling object is higher than the critical temperature of the refrigerant and closes the first opening and closing valve and the third opening and closing valve and opens the second opening and closing valve at least when the operating pressure value of the compression section is lower than the threshold value or the set temperature of the cooling object is lower than the critical temperature of the refrigerant, it is possible to perform the opening and closing control of the first opening and closing valve, the second opening and closing valve, and the third opening and closing valve on the basis of at least one of the operating pressure value of the compression unit and the set temperature of the cooling object and it is easy to maintain the temperature in the storage section at the critical temperature or more of the refrigerant (or a superheated steam temperature) due to the heat of the refrigerant flowing into the storage section while suppressing an excessive pressure in the flow path compared to a case in which the opening and closing control of the first opening and closing valve, the second opening and closing valve, and the third opening and closing valve is performed only on the basis of the set temperature of the cooling object.

Another embodiment of the present invention provides the refrigerant control system according to the above embodiment, further comprises: a fourth pipe which is connected to the outlet side pipe and is formed so that heat of the fourth pipe higher than heat of the third pipe is able to be transferred to the refrigerant in the storage section; and a fourth opening and closing valve which is provided in the fourth pipe and switches whether or not to allow the refrigerant in an upstream part in relation to the storage section in the fourth pipe to flow into a part on the side of the storage section in the fourth pipe, wherein the opening and closing control section performs opening and closing control of the first opening and closing valve, the second opening and closing valve, the third opening and closing valve, and the fourth opening and closing valve on the basis of the set temperature of the cooling object.

According to this embodiment, since there are provided a fourth pipe which is connected to the outlet side pipe and is formed so that heat of the fourth pipe higher than heat of the third pipe is able to be transferred to the refrigerant in the storage section; and a fourth opening and closing valve which is provided in the fourth pipe and switches whether or not to allow the refrigerant in an upstream part in relation to the storage section in the fourth pipe to flow into a part on the side of the storage section in the fourth pipe, it is possible to heat the refrigerant in the storage section by using the heat (warm heat) of the fourth pipe and to decrease the density of the refrigerant in the storage section while increasing the amount of the refrigerant in the flow path. Further, since the opening and closing control unit performs the opening and closing control of the first opening and closing valve, the second opening and closing valve, the third opening and closing valve, and the fourth opening and closing valve on the basis of the set temperature of the cooling object, it is possible to perform the opening and closing control of the first opening and closing valve, the second opening and closing valve, the third opening and closing valve, and the fourth opening and closing valve on the basis of the set temperature of the cooling object. Accordingly, it is possible to effectively cool and heat the refrigerant in the storage section and to store the refrigerant depending on the situation in the storage section.

Another embodiment of the present invention provides the refrigerant control system according to the above embodiment, wherein the opening and closing control section opens the first opening and closing valve and the third opening and closing valve and closes the second opening and closing valve and the fourth opening and closing valve when the set temperature of the cooling object is higher than the critical temperature of the refrigerant and closes the first opening and closing valve and the third opening and closing valve and opens the second opening and closing valve and the fourth opening and closing valve when the set temperature of the cooling object is lower than the critical temperature of the refrigerant.

According to this embodiment, since the opening and closing control section opens the first opening and closing valve and the third opening and closing valve and closes the second opening and closing valve and the fourth opening and closing valve when the set temperature of the cooling object is higher than the critical temperature of the refrigerant and closes the first opening and closing valve and the third opening and closing valve and opens the second opening and closing valve and the fourth opening and closing valve when the set temperature of the cooling object is lower than the critical temperature of the refrigerant, it is possible to perform the opening and closing control of the first opening and closing valve, the second opening and closing valve, the third opening and closing valve, and the fourth opening and closing valve depending on whether or not the set temperature of the cooling object is higher than the critical temperature of the refrigerant and to further effectively cool and heat the refrigerant in the storage section.

Another embodiment of the present invention provides the refrigerant control system according to the above embodiment, wherein the refrigerant in the storage section is able to be prevented from reversely flowing to the outlet side pipe or the inlet side pipe through the first pipe or the second pipe by forming the first pipe and the second pipe so that a part of each of the first pipe and the second pipe is located above the other part.

According to this embodiment, since the refrigerant in the storage section is able to be prevented from reversely flowing to the outlet side pipe or the inlet side pipe through the first pipe or the second pipe by forming the first pipe and the second pipe so that a part of each of the first pipe and the second pipe is located above the other part, the density of the refrigerant in the storage section becomes much larger than the density of the refrigerant in the first pipe and the second pipe when cooling the storage section. Accordingly, it is possible to prevent the refrigerant in the storage section from reversely flowing to the outlet side pipe or the inlet side pipe through the first pipe or the second pipe due to gravity and to accurately manage the amount of the refrigerant in the flow path.

Another embodiment of the present invention provides the refrigerant control system according to the above embodiment, further comprises: an inflow preventing section which prevents foreign matter from flowing into the storage section through the first pipe.

According to this embodiment, since there is provided an inflow preventing section which prevents foreign matter from flowing into the storage section through the first pipe, it is possible to prevent foreign matter from flowing into the storage section through the first pipe and to prevent the refrigerant in the storage section from being contaminated by foreign matter.

Another embodiment of the present invention provides the refrigerant control system according to the above embodiment, further comprises: a temperature adjustment section which adjusts a temperature of the refrigerant in the storage section.

According to this embodiment, since there is provided a temperature adjustment section which adjusts a temperature of the refrigerant in the storage section, it is possible to adjust the temperature of the refrigerant in the storage section. Accordingly, it is easily possible to cool the refrigerant in the storage section by using, for example, the heat (cold heat) of the temperature adjustment unit, and the refrigerant is easily stored at a high density in the storage section.

Another embodiment of the present invention provides the refrigerant control system according to the above embodiment, wherein the refrigerant is carbon dioxide.

According to this embodiment, since the refrigerant is carbon dioxide, it is possible to prevent the pressure in the flow path from becoming excessive even if carbon dioxide expands more easily than the chlorofluorocarbon gas.

Another embodiment of the present invention provides the refrigerant control system according to the above embodiment, wherein the cooling object is a refrigerant for cooling a semiconductor manufacturing system.

According to this embodiment, since the cooling object is the refrigerant for cooling the semiconductor manufacturing system, even when the temperature range of the cooling object is relatively wide, it is possible to prevent the pressure of the flow path from becoming excessive and to prevent the flow rate of the refrigerant in the flow path from decreasing due to the condensation of the refrigerant in the storage section.

Another embodiment of the present invention provides a cooling system for cooling the cooling object using the refrigerant comprises: a compression section which compresses the refrigerant; a circulation flow path which includes a cooling object side pipe connected to the compression section and located on the side of the cooling object and circulates the refrigerant so as to exchange heat between the refrigerant compressed by the compression section and the cooling object; the refrigerant control system according to any one of notes 1 to 10; and a heat exchange section which is provided in the cooling object side pipe and exchanges heat between the refrigerant in the cooling object side pipe and the cooling object.

According to this embodiment, since there are provided a first pipe which is connected to an outlet side pipe constituting the circulation flow path and located on an outlet side of the compression section and allows the refrigerant in the outlet side pipe to flow into the storage section through the first pipe; a second pipe which is connected to an inlet side pipe constituting the circulation flow path and located on an inlet side of the compression section and allows the refrigerant in the storage section to flow into the inlet side pipe through the second pipe; a third pipe which is connected to the inlet side pipe and is formed so that heat of the third pipe lower than heat of the outlet side pipe is able to be transferred to the refrigerant in the storage section; a first opening and closing valve which is provided in the first pipe and switches whether or not to allow the refrigerant in the outlet side pipe to flow into the storage section; a second opening and closing valve which is provided in the second pipe and switches whether or not to allow the refrigerant in the storage section to flow into the inlet side pipe; a third opening and closing valve which is provided in the third pipe and switches whether or not to allow the refrigerant in an upstream part in relation to the storage section in the third pipe to flow into a part on the side of the storage section in the third pipe, it is possible to cool the refrigerant in the storage section by using the heat (cold heat) of the third pipe. Accordingly, it is possible to store the refrigerant in the storage section at a high density and to make the storage section in a compact size while increasing the storage amount of the storage section. Further, since the opening and closing control unit is provided to perform the opening and closing control of the first opening and closing valve, the second opening and closing valve, and the third opening and closing valve on the basis of the set temperature of the cooling object, it is possible to perform the opening and closing control of the first opening and closing valve, the second opening and closing valve, and the third opening and closing valve based on the set temperature of the cooling object. Accordingly, it is possible to effectively cool the refrigerant in the storage section and to improve the usability of the refrigerant control system and the cooling system.

Another embodiment of the present invention provides the cooling system according to the above embodiment, wherein the heat exchange section includes a first heat exchange section which is able to cool the cooling object and a second heat exchange section which is able to heat the cooling object cooled by the first heat exchange section, wherein the cooling object side pipe includes a first cooling object side pipe which is located on the side of the first heat exchange section and a second cooling object side pipe which is located on the side of the second heat exchange section, wherein the cooling system further comprises: a detection section which detects a temperature in the outlet side pipe or a temperature in the inlet side pipe; a fifth pipe which is connected to an upstream part in relation to the first heat exchange section in the first cooling object side pipe and the inlet side pipe; and a fifth opening and closing valve which is provided in the fifth pipe and is able to adjust the amount of the refrigerant in the cooling object side pipe flowing into the inlet side pipe, and wherein the opening and closing control section performs opening degree control of the fifth opening and closing valve on the basis of a detection result of the detection section.

According to this embodiment, since the cooling object side pipe includes a first cooling object side pipe which is located on the side of the first heat exchange section and a second cooling object side pipe which is located on the side of the second heat exchange section, wherein the cooling system further comprises: a detection section which detects a temperature in the outlet side pipe or a temperature in the inlet side pipe; a fifth pipe which is connected to an upstream part in relation to the first heat exchange section in the first cooling object side pipe and the inlet side pipe; and a fifth opening and closing valve which is provided in the fifth pipe and is able to adjust the amount of the refrigerant in the cooling object side pipe flowing into the inlet side pipe, and wherein the opening and closing control section performs opening degree control of the fifth opening and closing valve on the basis of a detection result of the detection section, it is possible to adjust the opening degree of the fifth opening and closing valve on the basis of the temperature of the refrigerant and to efficiently adjust the temperature of the refrigerant in the outlet side pipe.

Another embodiment of the present invention provides the cooling system according to the above embodiment, further comprises: a sixth opening and closing valve which is provided in an upstream part in relation to the first heat exchange section in the first cooling object side pipe and is able to adjust the amount of the refrigerant in the first cooling object side pipe flowing into the first heat exchange section; and a seventh opening and closing valve which is provided in a downstream part in relation to the second heat exchange section in the second cooling object side pipe and is able to adjust the amount of the refrigerant exchanging heat by the second heat exchange section and flowing into the inlet side pipe, wherein the opening and closing control section performs opening degree control of the sixth opening and closing valve and the seventh opening and closing valve on the basis of a temperature of the cooling object acquired by a predetermined method.

According to this embodiment, since there is provided a sixth opening and closing valve which is provided in an upstream part in relation to the first heat exchange section in the first cooling object side pipe and is able to adjust the amount of the refrigerant in the first cooling object side pipe flowing into the first heat exchange section; and a seventh opening and closing valve which is provided in a downstream part in relation to the second heat exchange section in the second cooling object side pipe and is able to adjust the amount of the refrigerant exchanging heat by the second heat exchange section and flowing into the inlet side pipe, wherein the opening and closing control section performs opening degree control of the sixth opening and closing valve and the seventh opening and closing valve on the basis of a temperature of the cooling object acquired by a predetermined method, it is possible to adjust the opening degree of the sixth opening and closing valve and the seventh opening and closing valve on the basis of the temperature of the cooling object and to efficiently adjust the temperature of the refrigerant in the cooling object side pipe.

Another embodiment of the present invention provides the cooling system according to the above embodiment, further comprises: a compression control section which controls the compression section on the basis of the detection result of the detection section and the temperature of the cooling object acquired by the predetermined method.

According to this embodiment, since there is provided a compression control section which controls the compression section on the basis of the detection result of the detection section and the temperature of the cooling object acquired by the predetermined method, it is possible to control the compression unit on the basis of the temperature of the refrigerant and the temperature of the cooling object and to efficiently control the compression unit.

Another embodiment of the present invention provides the cooling system according to the above embodiment, further comprises: a refrigerant heat exchange section which exchanges heat between the refrigerant in the upstream part in relation to the first heat exchange section in the first cooling object side pipe and the refrigerant in the downstream part in relation to the second heat exchange section in the second cooling object side pipe.

According to this embodiment, since there is provided a refrigerant heat exchange section which exchanges heat between the refrigerant in the upstream part in relation to the first heat exchange section in the first cooling object side pipe and the refrigerant in the downstream part in relation to the second heat exchange section in the second cooling object side pipe, it is possible to increase the temperature of the refrigerant in the downstream part in relation to the second heat exchange unit in the second cooling object side pipe and to allow the dry refrigerant to flow into the compression unit.

EXPLANATION OF REFERENCE NUMBERS

1 Cooling system
10 First cooling system
20 Compression unit
21 Compression unit body
22 First outlet
23 First inlet
24 Second outlet
25 Second inlet
26 Third inlet
30 Storage part
41 First heat exchange unit
42 Second heat exchange unit
43 Third heat exchange unit
44 Fourth heat exchange unit
45 Fifth heat exchange unit
46 Sixth heat exchange unit
47 First removing unit
48 Second removing unit
50 Circulation unit
60 First circulation unit
61 First circulation flow path
62 Compression unit side pipe
62*a* Outlet side pipe
62*b* Inlet side pipe
62*c* Auxiliary pipe
62*d* Auxiliary valve
63 Cooling object side pipe
63*a* First cooling object side pipe
63*b* Second cooling object side pipe
71*a* First sub-pipe
71*b* Second sub-pipe
71*c* Third sub-pipe
71*d* Fourth sub-pipe
71*e* Fifth sub-pipe
71*f* Sixth sub-pipe
72*a* First opening and closing valve
72*b* Second opening and closing valve
72*c* Third opening and closing valve
72*d* Fourth opening and closing valve
72*e* Fifth opening and closing valve
72*f* Sixth opening and closing valve
72*g* Seventh opening and closing valve
72*h* Eighth opening and closing valve
73 Temperature detection unit
74*a* First pressure detection unit
74*b* Second pressure detection unit
74*c* Third pressure detection unit
75*a* First discharge valve
75*b* Second discharge valve
76 Inflow preventing portion
80 Second circulation unit
81 Second circulation flow path
82 Pressure detection unit
100 Second cooling system
110 Air vent unit
120 Storage part
121 Auxiliary tank
130 Delivery unit
131 Delivery flow path
132*a* First sub-delivery pipe
132*b* Second sub-delivery pipe
132*c* Third sub-delivery pipe
132*d* Fourth sub-delivery pipe
132*e* Fifth sub-delivery pipe
133*a* First delivery opening and closing valve
133*b* Second delivery opening and closing valve
133*c* Third delivery opening and closing valve
133*d* Fourth delivery opening and closing valve
133*e* Fifth delivery opening and closing valve
134 Pump unit
135*a* First delivery temperature detection unit
135*b* Second delivery temperature detection unit
135*c* Third delivery temperature detection unit
136 Delivery pressure detection unit
137 Flow rate detection unit
138 Level detection unit
200 Third cooling system
201 First delivery flow path
202 Second delivery flow path
203 Sixth delivery opening and closing valve
204 Seventh delivery opening and closing valve
205 Eighth delivery opening and closing valve
206 Delivery temperature detection unit
207 Removing unit
300 Control device
310 Operation unit
320 Communication unit
330 Output unit
340 Power supply unit
350 Control unit
351 Opening and closing control unit
352 Compression control unit
360 Storage unit All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A refrigerant control system for controlling a refrigerant flowing in a circulation flow path connected to a compression section and circulating the refrigerant compressed by the compression section so as to exchange heat between the refrigerant in the refrigerant control system and a cooling object, the refrigerant control system comprising:

a storage section which stores the refrigerant;

a first pipe which is connected to an outlet side pipe constituting the circulation flow path and located on an outlet side of the compression section and allows the refrigerant in the outlet side pipe to flow into the storage section through the first pipe;

a second pipe which is connected to an inlet side pipe constituting the circulation flow path and located on an inlet side of the compression section and allows the refrigerant in the storage section to flow into the inlet side pipe through the second pipe;

a third pipe which is connected to the inlet side pipe, the third pipe is formed such that a part of the third pipe is accommodated in the storage section or a part of the third pipe is wound around the outside surface of the storage section so that heat of the refrigerant in the third pipe lower than heat of the refrigerant in the outlet side pipe is able to be transferred to the refrigerant in the storage section;

a first opening and closing valve which is provided in the first pipe and switches whether or not to allow the refrigerant in the outlet side pipe to flow into the storage section;

a second opening and closing valve which is provided in the second pipe and switches whether or not to allow the refrigerant in the storage section to flow into the inlet side pipe;

a third opening and closing valve which is provided in the third pipe and switches whether or not to allow the refrigerant in an upstream part in relation to the storage section in the third pipe to flow into a part on the side of the storage section in the third pipe; and an opening and closing control section which performs opening and closing control of the first opening and closing valve, the second opening and closing valve, and the third opening and closing valve on the basis of a set temperature of the cooling object.

2. The refrigerant control system according to claim 1, wherein the opening and closing control section opens the first opening and closing valve and the third opening and closing valve and closes the second opening and closing valve when the set temperature of the cooling object is higher than a critical temperature of the refrigerant and closes the first opening and closing valve and the third opening and closing valve and opens the second opening and closing valve when the set temperature of the cooling object is lower than the critical temperature of the refrigerant.

3. The refrigerant control system according to claim 1, further comprising:

a fourth pipe which is connected to the outlet side pipe, the fourth pipe is formed such that a part of fourth pipe is accommodated in the storage section or a part of the fourth pipe is wound around the outside surface of the storage section so that heat of the refrigerant in the fourth pipe higher than heat of the refrigerant in the third pipe is able to be transferred to the refrigerant in the storage section; and a fourth opening and closing valve which is provided in the fourth pipe and switches whether or not to allow the refrigerant in an upstream part in relation to the storage section in the fourth pipe to flow into a part on the side of the storage section in the fourth pipe, wherein the opening and closing control section performs opening and closing control of the first opening and closing valve, the second opening and closing valve, the third opening and closing valve, and the fourth opening and closing valve on the basis of the set temperature of the cooling object.

4. The refrigerant control system according to claim 3, wherein the opening and closing control section opens the first opening and closing valve and the third opening and closing valve and closes the second opening and closing valve and the fourth opening and closing valve when the set temperature of the cooling object is higher than the critical temperature of the refrigerant and closes the first opening and closing valve and the third opening and closing valve and opens the second opening and closing valve and the fourth opening and closing valve when the set temperature of the cooling object is lower than the critical temperature of the refrigerant.

5. The refrigerant control system according to claim 1, wherein the refrigerant in the storage section is able to be prevented from reversely flowing to the outlet side pipe or the inlet side pipe through the first pipe or the second pipe by forming the first pipe and the second pipe so that a part of each of the first pipe and the second pipe is located above the other part.

6. The refrigerant control system according to claim 1, further comprising:

an inflow preventing section which prevents foreign matter from flowing into the storage section through the first pipe.

7. The refrigerant control system according to claim 1, further comprising:

a temperature adjustment section which adjusts a temperature of the refrigerant in the storage section.

8. The refrigerant control system according to claim 1, wherein the refrigerant is carbon dioxide.

9. The refrigerant control system according to claim 1, wherein the cooling object is a refrigerant for cooling a semiconductor manufacturing system.

10. A cooling system for cooling the cooling object using a refrigerant comprising:

a compression section which compresses the refrigerant;

a circulation flow path which includes a cooling object side pipe connected to the compression section and located on the side of the cooling object and circulates the refrigerant so as to exchange heat between the refrigerant compressed by the compression section and the cooling object;

the refrigerant control system according to claim 1; and a heat exchange section which is provided in the cooling object side pipe and exchanges heat between the refrigerant in the cooling object side pipe and the cooling object.

11. The cooling system according to claim 10, wherein the heat exchange section includes a first heat exchange section which is able to cool the cooling object and a second heat exchange section which is able to heat the cooling object cooled by the first heat exchange section, wherein the cooling object side pipe includes a first cooling object side pipe which is located on the side of the first heat exchange section and a second cooling object side pipe which is located on the side of the second heat exchange section, wherein the cooling system further comprises:

a detection section which detects a temperature in the outlet side pipe or a temperature in the inlet side pipe;

a fifth pipe which is connected to an upstream part in relation to the first heat exchange section in the first cooling object side pipe and the inlet side pipe; and a fifth opening and closing valve which is provided in the fifth pipe and is able to adjust the amount of the refrigerant in the cooling object side pipe flowing into the inlet side pipe, and wherein the opening and closing control section performs opening degree control of the fifth opening and closing valve on the basis of a detection result of the detection section.

12. The cooling system according to claim 11, further comprising:

a temperature detection unit for detecting a temperature of the cooling object, a sixth opening and closing valve which is provided in an upstream part in relation to the first heat exchange section in the first cooling object side pipe and is able to adjust the amount of the refrigerant in the first cooling object side pipe flowing into the first heat exchange section; and a seventh opening and closing valve which is provided in a downstream part in relation to the second heat exchange section in the second cooling object side pipe and is able to adjust the amount of the refrigerant exchanging heat by the second heat exchange section and flowing into the inlet side pipe, wherein the opening and closing control section performs opening degree control of the sixth opening and closing valve and the seventh opening and closing valve on the basis of the temperature of the cooling object detected by the temperature detection unit.

13. The cooling system according to claim 11, further comprising:

a temperature detection unit for detecting a temperature of the cooling object, a compression control section which controls the compression section on the basis of the detection result of the detection section and the temperature of the cooling object detected by the temperature detection unit.

14. The cooling system according to claim 11, further comprising:

a refrigerant heat exchange section which exchanges heat between the refrigerant in the upstream part in relation to the first heat exchange section in the first cooling object side pipe and the refrigerant in the downstream part in relation to the second heat exchange section in the second cooling object side pipe.

* * * * *